US011523660B2

(12) United States Patent
Bell et al.

(10) Patent No.: US 11,523,660 B2
(45) **Date of Patent: *Dec. 13, 2022**

(54) FOOTWEAR FASTENING SYSTEM

(71) Applicant: NIKE, Inc., Beaverton, OR (US)

(72) Inventors: Thomas G. Bell, Portland, OR (US); Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 66 days.

This patent is subject to a terminal disclaimer.

(21) Appl. No.: 17/097,180

(22) Filed: Nov. 13, 2020

(65) Prior Publication Data

US 2021/0068502 A1 Mar. 11, 2021

Related U.S. Application Data

(63) Continuation of application No. 16/371,574, filed on Apr. 1, 2019, now Pat. No. 10,863,797.

(Continued)

(51) Int. Cl.

| | |
|---|---|
| ***A43C 11/00*** | (2006.01) |
| ***A43C 11/14*** | (2006.01) |
| ***A43B 23/02*** | (2006.01) |
| ***A43B 3/24*** | (2006.01) |
| ***A43B 1/00*** | (2006.01) |
| ***A43B 3/06*** | (2006.01) |
| ***A43B 5/00*** | (2022.01) |

(Continued)

(52) U.S. Cl.

CPC ..... *A43C 11/008* (2013.01); *A43B 1/0054* (2013.01); *A43B 3/06* (2013.01); *A43B 3/242* (2013.01); *A43B 3/248* (2013.01); *A43B 5/00* (2013.01); *A43B 11/00* (2013.01); *A43B 23/0245* (2013.01); *A43C 1/00* (2013.01); *A43C 5/00* (2013.01); *A43C 11/1493* (2013.01)

(58) Field of Classification Search

CPC ..... A43B 1/0054; A43B 3/06; A43B 11/00; A43C 11/008; A43C 11/1493; A43C 11/14

USPC ..... 36/105, 50.1

See application file for complete search history.

(56) References Cited

U.S. PATENT DOCUMENTS

| | | | |
|---|---|---|---|
| 645,467 | A | 3/1900 | Fowler |
| 1,114,435 | A | 10/1914 | Batten |

(Continued)

FOREIGN PATENT DOCUMENTS

| | | | |
|---|---|---|---|
| CA | 1141535 | A | 2/1983 |
| CN | 102970889 | A | 3/2013 |

(Continued)

*Primary Examiner* — Marie D Bays

(74) *Attorney, Agent, or Firm* — Quinn IP Law

(57) ABSTRACT

An article of footwear facilitates relatively easy donning and removal, and secure adjustment. The article of footwear comprises a sole structure, an upper secured to the sole structure, and a plurality of tensioning cables having proximal ends fixed to at least one of the upper or the sole structure and extending out of the upper. A strap has a proximal end connected to distal ends of the plurality of tensioning cables, and has a distal end releasably securable to the upper to tighten the tensioning cables. A webbed spacer is secured to the plurality of tensioning cables. The webbed spacer extends between adjacent ones of the plurality of tensioning cables, and the adjacent ones of the plurality of tensioning cables spaced apart from one another by the webbed spacer.

19 Claims, 19 Drawing Sheets

Related U.S. Application Data

(60) Provisional application No. 62/657,267, filed on Apr. 13, 2018.

(51) Int. Cl.

| | |
|---|---|
| ***A43B 11/00*** | (2006.01) |
| ***A43C 1/00*** | (2006.01) |
| ***A43C 5/00*** | (2006.01) |

(56) References Cited

U.S. PATENT DOCUMENTS

| | | | | |
|---|---|---|---|---|
| 2,266,083 | A * | 12/1941 | Rzepa | A43C 11/22 24/267 |
| 3,192,651 | A * | 7/1965 | Smith | A43B 3/24 36/105 |
| 4,079,527 | A | 3/1978 | Antonious | |
| 4,081,916 | A * | 4/1978 | Salisbury | A43C 11/008 36/50.1 |
| 4,451,995 | A | 6/1984 | Antonious | |
| 4,486,965 | A | 12/1984 | Friton | |
| 4,547,981 | A | 10/1985 | Thais et al. | |
| 4,811,498 | A | 3/1989 | Barret | |
| 4,845,864 | A * | 7/1989 | Corliss | A43B 5/14 36/131 |
| 5,027,482 | A * | 7/1991 | Torppey | A43C 11/1493 24/712.1 |
| 5,659,982 | A | 8/1997 | Muraoka et al. | |
| 6,594,921 | B2 * | 7/2003 | Laio | A43C 11/00 36/105 |
| 7,490,417 | B2 * | 2/2009 | Petrie | A43C 11/20 36/170 |
| 7,874,997 | B2 | 1/2011 | Jaccard | |
| 8,448,353 | B2 * | 5/2013 | Seliger | A43C 1/04 36/50.1 |
| 8,887,410 | B2 * | 11/2014 | Dojan | A43B 23/0295 36/3 A |
| 9,392,838 | B2 | 7/2016 | Fischer et al. | |
| 9,516,920 | B1 | 12/2016 | DeRose | |
| D814,169 | S * | 4/2018 | Ngene | D2/978 |
| 10,136,694 | B2 | 11/2018 | Fischer et al. | |
| 10,602,802 | B2 | 3/2020 | Hopkins et al. | |
| 11,026,473 | B2 | 6/2021 | Berns et al. | |
| 2002/0050076 | A1 | 5/2002 | Borsoi et al. | |
| 2002/0166260 | A1 * | 11/2002 | Borsoi | A43B 5/0401 36/50.1 |
| 2003/0051374 | A1 * | 3/2003 | Freed | A43C 11/008 36/50.1 |
| 2004/0078999 | A1 * | 4/2004 | Freed | A43C 11/008 36/50.1 |
| 2008/0196212 | A1 | 8/2008 | Nelson et al. | |
| 2009/0076428 | A1 | 3/2009 | Kay | |
| 2009/0100649 | A1 * | 4/2009 | Bar | A43C 11/14 24/306 |
| 2009/0100707 | A1 * | 4/2009 | Bar | A43C 11/008 36/50.1 |
| 2009/0293240 | A1 | 12/2009 | Hubbard | |
| 2010/0036304 | A1 | 2/2010 | Norton | |
| 2010/0154256 | A1 * | 6/2010 | Dua | D04B 1/16 12/146 B |
| 2010/0199522 | A1 * | 8/2010 | Hwang | A43B 23/047 36/102 |
| 2012/0079741 | A1 | 4/2012 | Kohatsu | |
| 2014/0196311 | A1 | 7/2014 | Follet et al. | |
| 2014/0196317 | A1 | 7/2014 | Katz et al. | |
| 2015/0047225 | A1 * | 2/2015 | Zavala | A43B 1/04 12/142 R |
| 2015/0096196 | A1 | 4/2015 | Normand | |
| 2015/0223554 | A1 | 8/2015 | Ardell et al. | |
| 2016/0081421 | A1 | 3/2016 | Fischer et al. | |
| 2016/0309831 | A1 | 10/2016 | Fischer et al. | |
| 2017/0143079 | A1 | 5/2017 | Bishop et al. | |
| 2018/0116343 | A1 | 5/2018 | Hei | |
| 2018/0199659 | A1 | 7/2018 | Lintaman | |
| 2018/0295942 | A1 * | 10/2018 | Drake | A43B 11/00 |
| 2019/0021447 | A1 | 1/2019 | Whewell et al. | |
| 2020/0323308 | A1 | 10/2020 | Dubuisson | |
| 2021/0186146 | A1 | 6/2021 | Erwin | |

FOREIGN PATENT DOCUMENTS

| | | | |
|---|---|---|---|
| CN | 205611886 | U | 10/2016 |
| CN | 106136418 | A | 11/2016 |
| DE | 10208853 | C1 | 6/2003 |
| EP | 0252517 | A2 | 1/1988 |
| JP | H10179210 | A | 7/1998 |
| JP | 2017526442 | A | 9/2017 |
| TW | M261248 | U | 4/2005 |

* cited by examiner

FOOTWEAR FASTENING SYSTEM

CROSS-REFERENCE TO RELATED APPLICATIONS

This application is a continuation of U.S. Nonprovisional application Ser. No. 16/371,574 filed Apr. 1, 2019, which claims the benefit of priority to U.S. Provisional Application No. 62/657,267 filed Apr. 13, 2018, and both of which are incorporated by reference in their entirety.

TECHNICAL FIELD

The present teachings generally include footwear having an upper and a fastening system configured for easy foot insertion and fastening.

BACKGROUND

Footwear may include a sole structure configured to be located under a wearer's foot to space the foot away from the ground. A footwear upper attached to the sole structure receives the foot. The fit of the upper to the foot may be adjusted with a fastening system so that the upper is loose enough to receive the foot but can be tightened around the foot to secure the foot relative to the sole structure. For example, a closure system, such as a lacing system, may include laces that are tied once the foot is received within the upper. Traditionally, placing footwear on a foot often requires the use of one or both hands to stretch the ankle opening of an upper, and hold the rear portion during foot insertion. The fit of the upper is then adjusted following foot insertion, such as by tying laces.

DESCRIPTION

Figure 1:
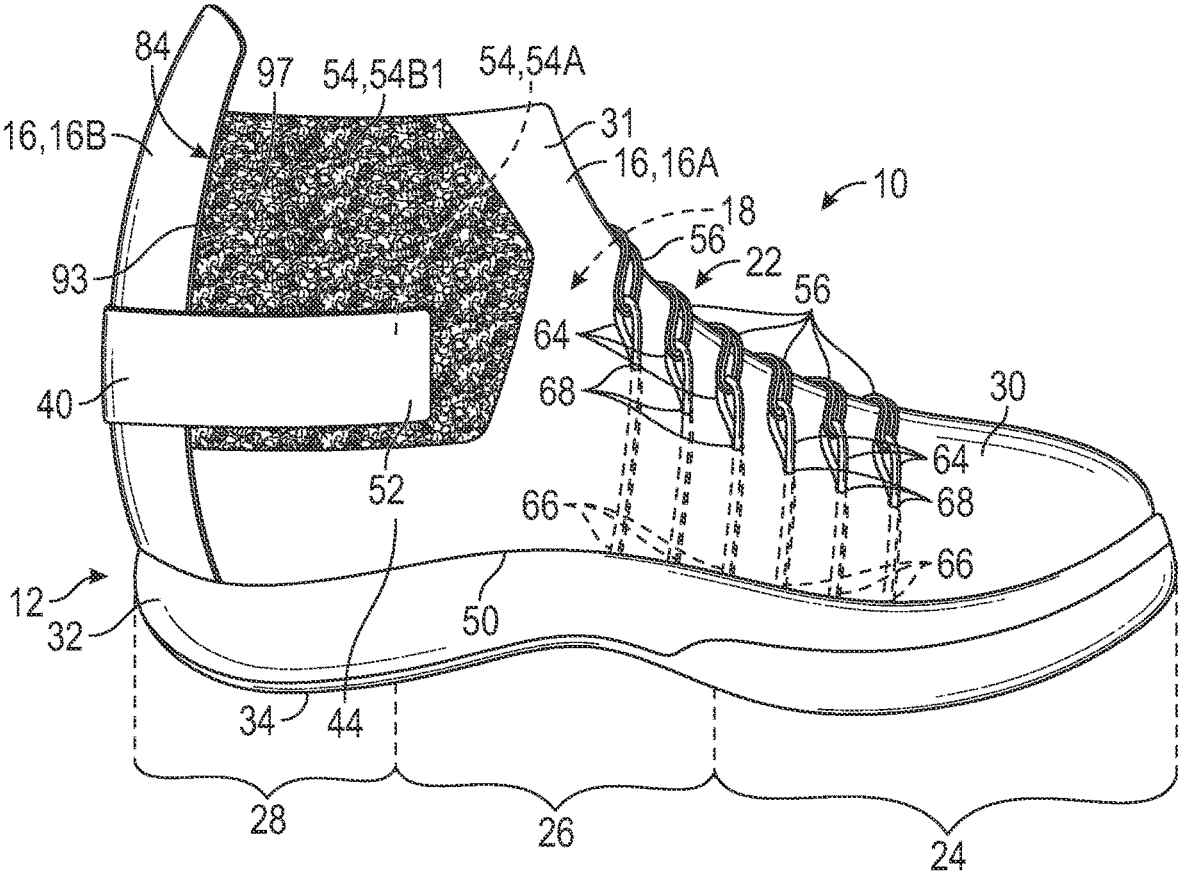
FIG. 1 is a schematic illustration in medial side view of an article of footwear with a distal end of a strap to an upper and a rear section of the upper in a use position.

An article of footwear is disclosed that facilitates relatively easy foot insertion and removal, and secure adjustment. The article of footwear comprises a sole structure, an upper secured to the sole structure, and a plurality of tensioning cables having proximal ends fixed to at least one of the upper or the sole structure. The plurality of tensioning cables extends out of the upper. A strap has a proximal end connected to distal ends of the tensioning cables. The strap also has a distal end releasably securable to the upper to tighten the tensioning cables. A webbed spacer is secured to the plurality of tensioning cables. The webbed spacer extends between adjacent ones of the plurality of tensioning cables, and the adjacent ones of the plurality of tensioning cables are spaced apart from one another by the webbed spacer.

In one or more embodiments, the webbed spacer is a flexible polymeric material. The webbed spacer may be disposed against an outer surface of the upper at a first side of the upper when the distal end of the strap is secured to the upper. The webbed spacer may be relatively thin and flat, allowing it to conform to the shape of the outer surface of the upper against which it is disposed. Because the webbed spacer rests against the first side of the upper when the strap is secured to the upper, the webbed spacer may help prevent abrasion of the tensioning cables under forces against the first side, especially in comparison to tensioning cables disposed on the first side and not connected to a webbed spacer.

In one or more embodiments, the webbed spacer tapers from a proximal edge to a distal edge, and a spacing between the adjacent ones of the plurality of tensioning cables decreases along the webbed spacer toward the strap. The width of the strap may be narrower than the distance from a forward-most one to rearmost one of the plurality of tensioning cables at their proximal ends. The spacing between the adjacent ones of the plurality of tensioning cables decreases from their proximal ends to their distal ends.

In one or more embodiments, a plurality of looped cables is fixed to at least one of the upper or the sole structure and extend out of the upper. The plurality of tensioning cables extends through the plurality of looped cables between the proximal ends of the tensioning cables and the webbed spacer. For example, the plurality of tensioning cables may extend upward along a first side of the upper from the proximal ends of the plurality of tensioning cables, and the plurality of looped cables may extend upward on a second side of the upper. When the distal end of the strap is secured to the upper, the webbed spacer rests against the lateral side of the upper, and the plurality of tensioning cables turn in direction at the plurality of looped cables.

The strap secures to the upper by a single pull of the strap around the rear section and a press of the distal end of the strap against the front section of the upper. The article of footwear may be useful for quick donning, and for those with limited dexterity, as no lace tightening or tying is necessary. To further increase ease of foot insertion and removal, the fastening system, including the strap, the plurality of tensioning cables, and the webbed spacer may be used with an upper that has an articulating rear section for easy foot insertion and removal. For example, in one or more embodiments, the upper includes a front section and a rear section. The front section is fixed to a forefoot region of the sole structure. The rear section is operatively secured to the sole structure at least partially rearward of the front section. The rear section articulates between an access position and a use position. The foot-receiving cavity is more exposed (i.e., more open) at a heel region of the article of footwear when the rear section is in the access position than when the rear section is in the use position, and the rear section partially encloses the heel region when the rear section is in the use position. The strap is configured to wrap behind the rear section from a first side of the front section to a second side of the front section, and secure to the second side of the front section when the rear section is in the use position.

The strap and the upper may have fastener portions that cooperate to help maintain the rear section in the use position when the strap is releasably secured to the upper. For example, a first fastener portion may be secured to the strap at the distal end of the strap, and a second fastener portion may be secured to the second side of the front section of the upper. The first fastener portion is configured to secure to the second fastener portion.

In one or more embodiments, the strap has a plurality of fastener portions spaced along an inner side of the strap, and the upper has a plurality of fastener portions secured to the first side and to the second side of the front section, and, in some embodiments, to the rear section. The fastener portions of the strap are configured to secure to the fastener portions of the upper. If the material of the strap is more elastic than the fastener portions, spacing the multiple fastener portions along the strap may allow the strap to stretch between adjacent fastening portions, and enables varied positioning of the strap on the upper in the secured state.

In one or more embodiments, a rear medial edge of the front section interfaces with the rear section at a medial side interface, and a rear lateral edge of the front section interfaces with the rear section at a lateral side interface, the plurality of fastener portions of the upper include a front section medial side fastener portion and a rear section medial side fastener portion, both bordering the medial side interface. The fastener portions of the upper include a front section lateral side fastener portion and a rear section lateral side fastener portion, both bordering the lateral side interface. The strap crosses over the medial side interface and the lateral side interface when the rear section is in the use position, and the plurality of fastener portions of the strap is secured to the front section medial side fastener portion, to the rear section medial side fastener portion, to the front section lateral side fastener portion, and to the rear section lateral side fastener portion. In another embodiment, a single fastener portion extends across the rear section from the medial side to the lateral side.

Additional features may be included to assist articulation of the rear section articulate to the use position, and/or to maintain the rear section in the use position. In one or more embodiments, a magnetic coupling may be used. More specifically, the article of footwear may further comprise a medial set of magnetic elements and a lateral set of magnetic elements. The medial set of magnetic elements includes at least one forward medial magnetic element secured to the medial side of the front section, and at least one rear medial magnetic element secured to the medial side of the rear section. The lateral set of magnetic elements includes at least one forward lateral magnetic element secured to the lateral side of the front section, and at least one rear lateral magnetic element secured to the lateral side of the rear section. The rear section is secured to the front section in the use position at least partially by a magnetic coupling of the at least one forward medial magnetic element to the at least one rear medial magnetic element across the medial side interface, and by a magnetic coupling of the at least one forward lateral magnetic element to the at least one rear lateral magnetic element across the lateral side interface.

Alternatively, in one or more embodiments, instead of or in addition to magnetic elements, the rear section may articulate by folding, such as articulating from the use position to the access position by folding rearward. In such an embodiment, a forward medial edge of the rear section is nearer to the rear medial edge of the front section when the rear section is in the use position than when the rear section is in the access position, and a forward lateral edge of the rear section is nearer to the rear lateral edge of the front section when the rear section is in the use position than when the rear section is in the access position. Depending upon the girth of an ankle when a foot is inserted into the foot-receiving cavity, the use position of the rear section may be slightly more forward or more rearward relative to the front section, but in all cases, is more forward than the access position. For example, for an ankle of relatively small girth, the forward medial edge of the rear section is forward and inward of the rear medial edge of the front section when the rear section is in the use position, and the forward lateral edge of the rear section is forward and inward of the rear lateral edge of the front section when the rear section is in the use position. In other words, the rear section folds slightly inward of the front section, similar to a shoe tongue relative to medial and lateral sides of an upper. For an ankle of relatively large girth, the forward medial edge of the rear section is adjacent to but slightly rearward of the rear medial edge of the front section when the rear section is in the use position, and the forward lateral edge of the rear section is adjacent to but slightly rearward of the rear lateral edge of the front section when the rear section is in the use position.

The front section may be configured to help avoid a tendency of the front section to collapse during foot insertion under the force of a foot slightly misaligned with the foot-receiving cavity. For example, in one or more embodiments, the medial side interface and the lateral side interface are substantially vertical because a rear medial edge and a rear lateral edge of the front section are substantially vertical and are entirely in a heel portion of the footwear. This arrangement may provide greater resistance to crush and collapse of the front section than a forwardly-angled rear medial edge and rear lateral edge of the front section during misdirected foot insertion. In addition, in an embodiment with lateral and medial sets of magnetic elements adjacent the interfaces, the magnetic elements and any housings for the magnetic elements may help provide greater lateral support to the foot when the rear section is in the use position, especially when the medial and lateral side interfaces are substantially vertical and entirely in a heel portion of the footwear.

In one or more embodiments, an article of footwear comprises a sole structure, and an upper including a front section and a rear section. The front section is fixed to a forefoot region of the sole structure and partially defines a foot-receiving cavity over the sole structure. The rear section is operatively secured to the sole structure at least partially rearward of the front section, and articulates between an access position and a use position. The foot-receiving cavity is exposed at a heel region of the article of footwear when the rear section is in the access position, and the rear section partially encloses the heel region when the rear section is in the use position. A plurality of tensioning cables extends upward along the front section from proximal ends that are fixed to at least one of the front section of the upper and the sole structure. A strap has a proximal end connected to distal ends of the tensioning cables. The strap is configured to wrap around the rear section from a first side of the upper to a second side of the upper. A fastener is configured to secure the distal end of the strap to the second side of the upper. A webbed spacer is adjacent to the proximal end of the strap and is secured to the plurality of tensioning cables. The webbed spacer extends between adjacent ones of the plurality of tensioning cables, and the adjacent ones of the plurality of tensioning cables are spaced apart from one another by the webbed spacer.

In one or more embodiments, an article of footwear comprises a sole structure, an upper secured to the sole structure, and a medial-side flap secured at a medial side wall of the sole structure and extending upward in a midfoot region of the article of footwear. The article of footwear includes a plurality of tensioning cables, a plurality of looped cables, and a strap. The tensioning cables extend upward along a lateral side of the upper. The looped cables are fixed to at least one of the upper or the medial-side flap. The strap has a proximal end connected to distal ends of the tensioning cables. A distal end of the strap is releasably securable to the upper to tighten the tensioning cables. The tensioning cables extend through the looped cables between proximal ends of the tensioning cables and the strap.

In one or more embodiments, the article of footwear may include a webbed spacer secured to the plurality of tensioning cables, the webbed spacer extending between adjacent ones of the plurality of tensioning cables, the adjacent ones of the plurality of tensioning cables spaced apart from one another by the webbed spacer. The medial-side flap may be fixed to the proximal end of the webbed spacer. The medial-side flap may lay against an outer surface of the upper and cover at least some of the plurality of looped cables when the strap is secured to the upper. Both the plurality of tensioning cables and the plurality of looped cables may extend through the upper.

In one or more embodiments, the medial-side flap is configured with a first portion that extends rearwardly and upwardly from the sole structure, and with a second portion that extends forwardly and upwardly from the sole structure. The second portion is at least partially rearward of the first portion at the sole structure.

In one or more embodiments, the medial-side flap is an outer medial-side flap, and an inner medial-side flap is secured to the medial side of the upper and disposed between the upper and the outer medial-side flap. The looped cables extend from the inner medial-side flap to the outer medial-side flap.

In one or more embodiments, the medial-side flap is an outer medial-side flap, and an inner medial-side flap is disposed between the upper and the outer medial-side flap. The inner medial-side flap is fixed to a foot-facing surface of the sole structure inward of a medial periphery of the foot-facing surface. The looped cables extend from the inner medial-side flap to the outer medial-side flap.

In one or more embodiments, a lateral-side flap is secured to a lateral side of the sole structure and extends upward along the lateral side of the upper in the midfoot region of the article of footwear. Each of the plurality of tensioning cables may be secured to the lateral-side flap and may extend from a free edge of the lateral side flap.

In one or more embodiments, the lateral-side flap has an inner layer and an outer layer. The outer layer has an opening, and at least one of the plurality of tensioning cables extends across and is exposed at the opening.

In one or more embodiments, a webbed spacer is secured to the plurality of tensioning cables between the looped cables and the strap. The webbed spacer extends between adjacent ones of the plurality of tensioning cables such that the adjacent ones of the plurality of tensioning cables are spaced apart from one another by the webbed spacer. The webbed spacer may rest against the lateral side of the upper when the distal end of the strap is secured to the upper, with the plurality of tensioning cables turning in direction at the plurality of looped cables.

In one or more embodiments, a first fastener portion is secured to the strap at the distal end of the strap, and a second fastener portion is secured to the upper. The first fastener portion is configured to secure to the second fastener portion.

In one or more embodiments, the upper includes a front section and a rear section that form a foot-receiving cavity. The front section is fixed to at least a forefoot region of the sole structure. The rear section is operatively secured to the sole structure at least partially rearward of the front section and articulates between an access position and a use position. The foot-receiving cavity is exposed at a heel region of the article of footwear when the rear section is in the access position, and the rear section partially encloses the heel region when the rear section is in the use position. The strap is configured to wrap behind the rear section from the lateral side of the front section to the medial side of the front section, and secure to the medial side of the upper when the rear section is in the use position.

In one or more embodiments, the strap has a plurality of fastener portions spaced along an inner side of the strap. The upper has a plurality of fastener portions secured to rear section, to the lateral side of the front section, and to the medial side of the front section. The fastener portions of the strap are configured to secure to the fastener portions of the upper.

In one or more embodiments, the rear section of the upper has fastener portions on an inner side of the rear section. The fastener portions on the inner side of the rear section secure to the fastener portions on an outer surface of the front section when the rear section is in the use position.

The above features and advantages and other features and advantages of the present teachings are readily apparent from the following detailed description of the modes for carrying out the present teachings when taken in connection with the accompanying drawings.

To assist and clarify the subsequent description of various embodiments, various terms are defined herein. Unless otherwise indicated, the following definitions apply throughout this specification (including the claims).

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal", as used throughout this detailed description and in the claims, refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse", as used throughout this detailed description and in the claims, refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical", as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" shall refer to the direction toward the interior of the component or article of footwear, such as a shoe, and the terms "outward" and "outwardly" shall refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

Referring to the drawings, wherein like reference numbers refer to like components throughout the views, various embodiments of footwear are disclosed having features that enable foot insertion and securement quickly and with relative ease, and with less manual dexterity necessary than for footwear that requires manually stretching a throat area to enlarge a foot opening and that requires securement by tightening and tying a lace. More specifically, with reference to FIG. 1, an article of footwear 10 has a sole structure 12 and an upper 16 secured to the sole structure 12. The upper 16 forms a foot-receiving cavity 18 configured to receive a foot 20 (shown in phantom in FIG. 4) without manually stretching the upper to enlarge an opening of the foot-receiving cavity 18. The upper 16 is tightened and secured around the foot 20 with a fastening system 22 that does not require any adjustment of laces or tying of laces.

The footwear 10 illustrated herein is depicted as an athletic shoe configured for sports such as basketball, but the footwear 10 and fastening system 22 are not limited to basketball shoes or other sports shoes. The fastening system 22 and other features of the article of footwear 10 may be also be used in footwear for various other sports such as but not limited to running, tennis, football, soccer, etc. The fastening system 22 and other features of the article of footwear may also be included in an article of footwear that is a leisure shoe, a dress shoe, a work shoe, a sandal, a slipper, a boot, or any other category of footwear.

As indicated in FIG. 1, the footwear 10 may be divided into a forefoot region 24, a midfoot region 26, a heel region 28, and an ankle region 31, which are also the forefoot region, the midfoot region, and the heel region, respectively, of the sole structure 12 and the upper 16, and with the ankle region 31 defined by the upper 16. The forefoot region 24 generally includes portions of the article of footwear 10 corresponding with the toes and the joints connecting the metatarsals with the phalanges. The midfoot region 26 generally includes portions of the article of footwear 10 corresponding with the arch area and instep of the foot, and the heel region 28 corresponds with rear portions of the foot, including the calcaneus bone. The ankle region 31 corresponds with the ankle. The forefoot region 24, the midfoot region 26, the heel region 28, and the ankle region 31 are not intended to demarcate precise areas of the footwear 10, but are instead intended to represent general areas of the footwear 10 to aid in the following discussion.

The sole structure 12 includes a midsole 32 and an outsole 34. The midsole 32 may be formed from a compressible polymer foam element (e.g., a polyurethane or ethylvinylacetate foam) that attenuates ground reaction forces (i.e., provides cushioning) when compressed between the foot 20 and the ground during walking, running, or other ambulatory activities. In further configurations, the midsole 32 may incorporate fluid-filled chambers, plates, moderators, or other elements that further attenuate forces, enhance stability, or influence the motions of the foot 20. The midsole 32 may be a single, one-piece midsole, or could be multiple components integrated as a unit. In some embodiments, the midsole 32 may be integrated with the outsole 34 as a unisole. The outsole 34 may be one-piece, or may be several outsole components, and may be formed from a wear-resistant rubber material that may be textured to impart traction and/or may include traction elements such as cleats secured to the midsole 32.

The upper 16 includes a front section 16A and a separate rear section 16B. In the embodiment of FIGS. 1-4, the sections 16A, 16B are configured to cooperate so that the rear section 16B is movable from an access position (FIG. 4) to a use position (FIG. 1) after foot entry. The movement may be accomplished in a hands-free manner or manually. For example, a wearer's other foot can be used to move the rear section 16B to the use position. As discussed herein, these and other features of the article of footwear 10 enable the access position to afford easy, hands-free foot entry into the article of footwear 10. The use position is maintained via a strap 40 of the fastening system 22 that secures the rear section 16B to the front section 16A.

When the foot 20 is positioned within the foot-receiving cavity 18 of the footwear 10, it is supported on a foot-facing surface of the midsole 32. The foot-facing surface of the midsole 32 may be covered by a strobel (not shown) secured to a lower region of the upper 16. Also, an insole (not shown) may rest on the strobel or directly on the sole structure 12 in embodiments without a strobel, in which case the foot 20 is supported by both the sole structure 12 and the insole.

The footwear 10 has a lateral side 42 (shown in FIG. 2), also referred to as a first side, and a medial side 44 (shown in FIG. 1), also referred to as a second side. The lateral side 42 and medial side 44 extend through each of the forefoot region 24, the midfoot region 26, the heel region 28, and the ankle region 31, and correspond with opposite sides of the article of footwear 10, each falling on an opposite side of a longitudinal midline of the article of footwear 10, as is understood by those skilled in the art. The medial side 44 is thus considered opposite to the lateral side 42.

The upper 16 may be a variety of materials, such as leather, textiles, polymers, cotton, foam, composites, etc. The front section 16A may include a body 30 that of a material that has greater elasticity, greater breathability, or both greater elasticity and greater breathability than the material or materials of the rear section 16B to aid with foot insertion and comfort. The rear section 16B may be one or more materials that are stiffer than the body 30 of the front section 16A to provide stability in the heel region 28. For example, the front section 16A may be a polymeric material capable of providing elasticity, and may be of a braided construction, a knitted (e.g., warp-knitted) construction, or a woven construction.

Figure 4:
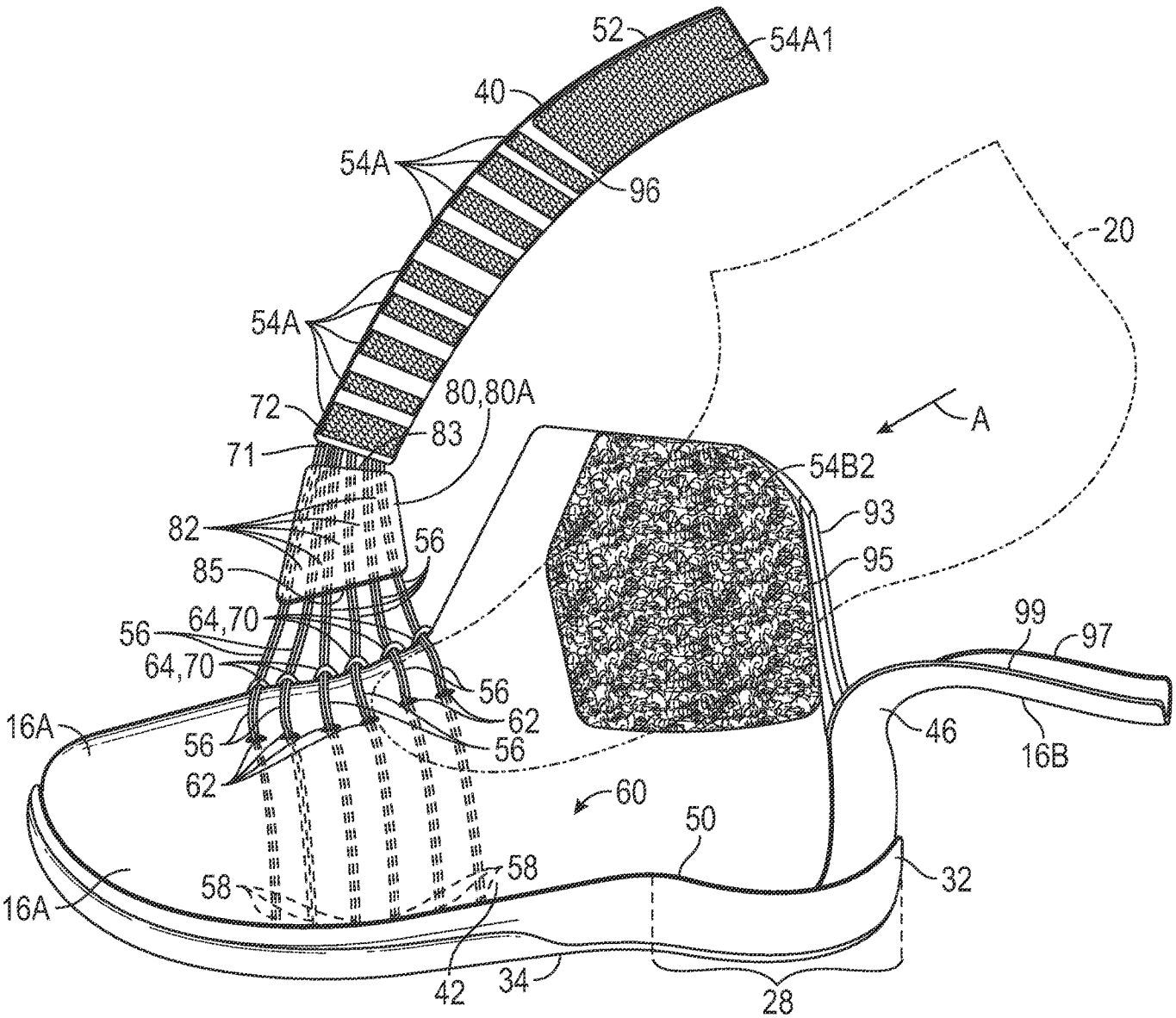
FIG. 4 is a schematic illustration in perspective lateral side view of the article of footwear of FIG. 1 with the distal end of the strap in an unsecured position, and a rear section of the upper in an access position.
Figure 9:
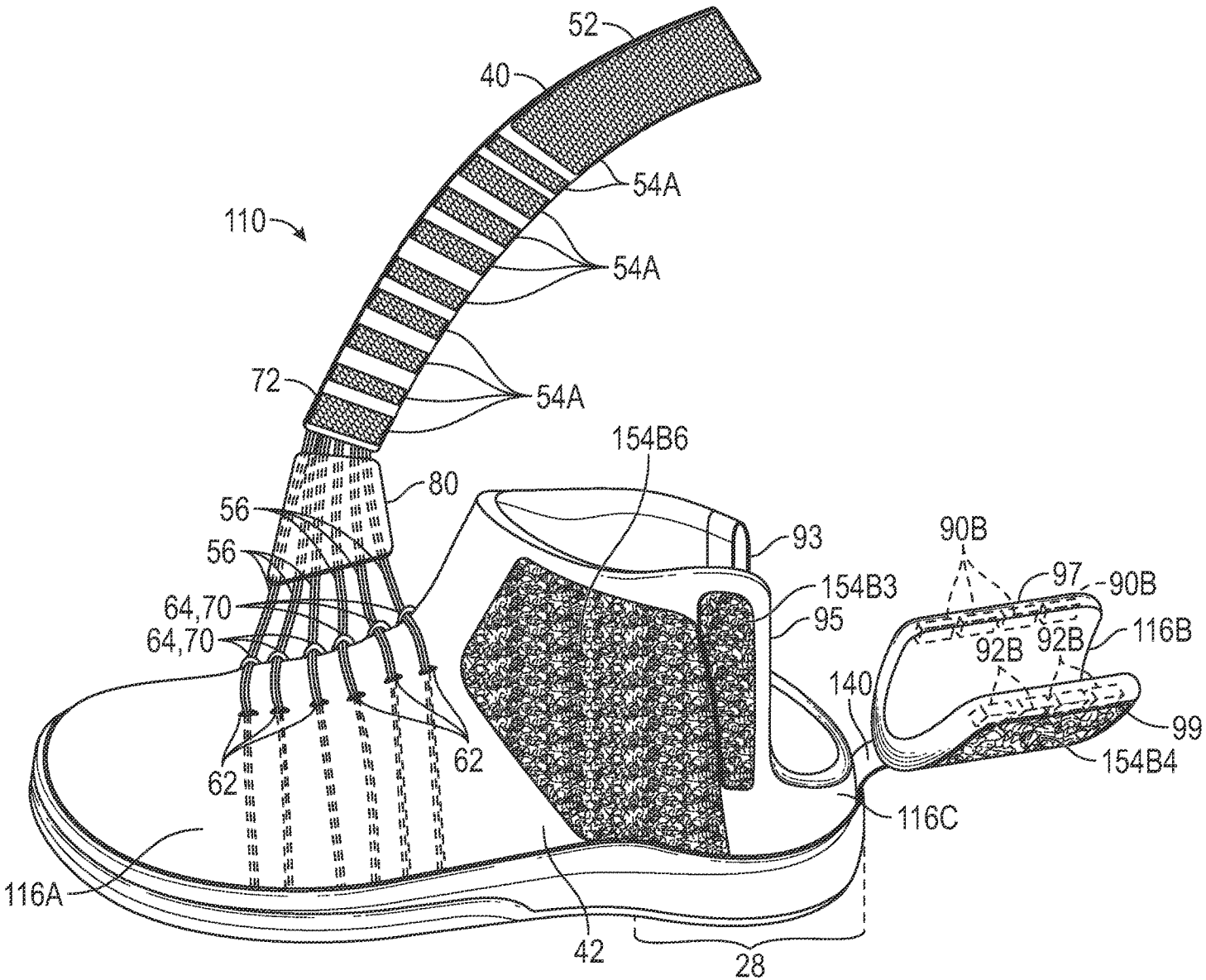
FIG. 9 is a schematic illustration in perspective lateral side view of the article of footwear of FIG. 5 with, the distal end of the strap in an unsecured position, and a rear section of an upper in an access position.
Figure 10:
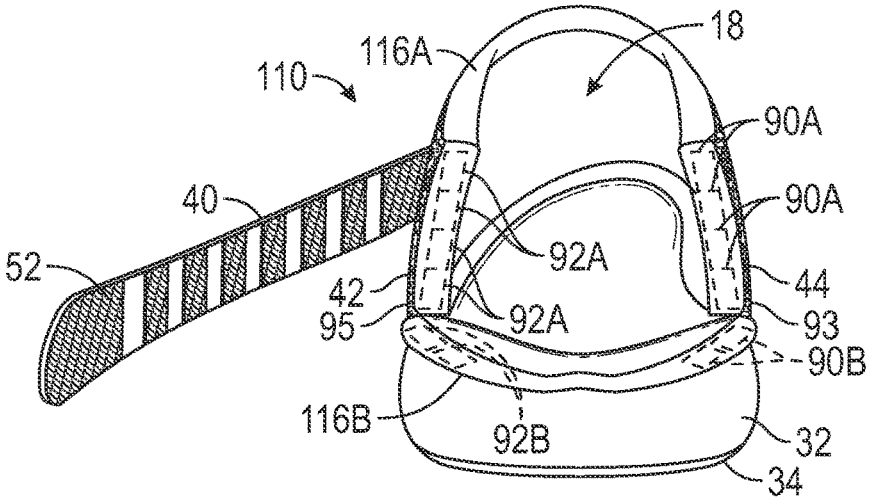
FIG. 10 is a schematic illustration in rear view of the article of footwear of FIG. 5 with the strap in an unsecured position and the rear section in the access position.

The fastening system 22 includes the strap 40 as well as cables and fasteners, as discussed herein. The strap 40 has a distal end 52 that is releasably securable to the medial side 44 of the front section 16A of the upper 16 via a fastener 54 by a single pressing motion of the distal end 52 toward the front section 16A, and releases from the medial side 44 of the front section 16A via a single peeling motion away from the upper 16. The fastening system 22 provides an adjustable, secure fit to tighten the body 30 of the front section 16A around the foot 20 when the rear section 16B is in the access position, to thereby secure the foot 20 relative to the sole structure 12 underlying the upper 16. The distal end 52 of the strap is further from the upper 16 than is a proximal end 72 of the strap 40 when the strap 40 is held outward from the upper 16 as illustrated in FIGS. 4 and 9. As used herein, an "end" of a component is not limited to a terminal edge of a component, but instead also includes a portion of the component in the vicinity of the terminal end.

Figure 2:
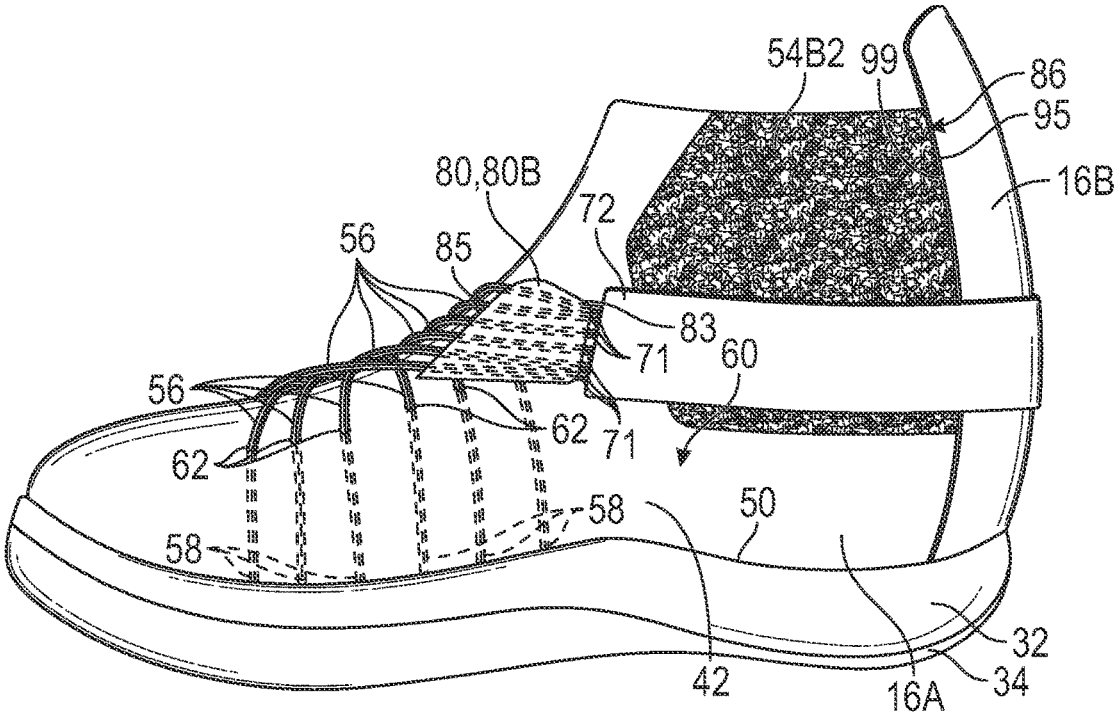
FIG. 2 is a schematic illustration in lateral side view of the article of footwear of FIG. 1.
Figure 3:
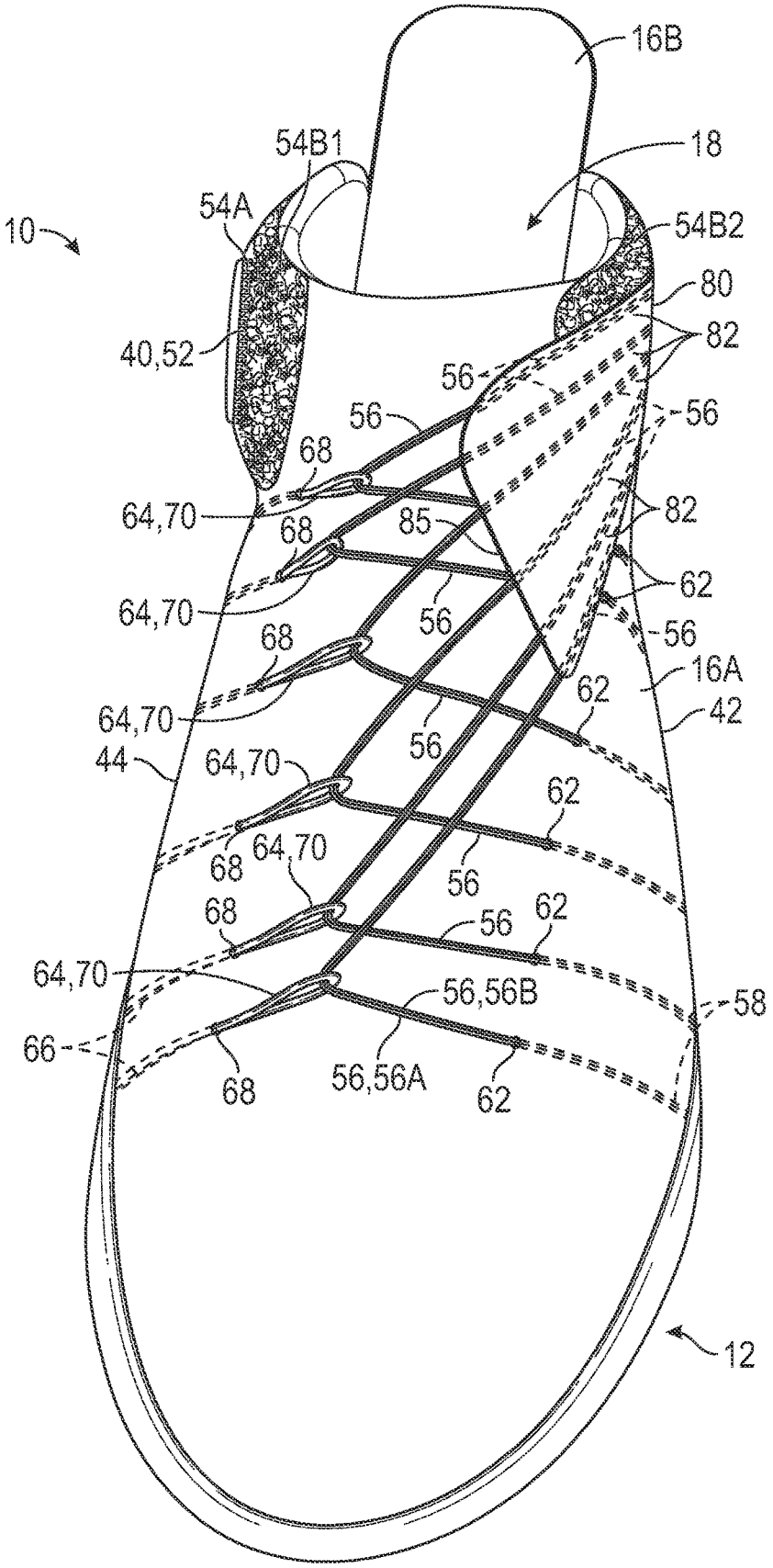
FIG. 3 is a schematic illustration in front perspective view of the article of footwear of FIG. 1.

With reference to FIGS. 2-4, the fastening system 22 also includes a first plurality of tensioning cables 56. The tensioning cables 56 have proximal ends 58 that are fixed to at least one of the front section 16A or the sole structure 12 on the lateral side 42 near the bite line 50. The tensioning cables 56 are disposed either within the body 30 of the front section 16A near the proximal ends 58, or are at least inward of an outer surface 60 of the front section 16A until they emerge from the upper 16 at apertures 62 in the front section 16A, where the tensioning cables 56 extend out of the front section 16A. For example, the tensioning cables 56 may be disposed between inner and outer layers of the front section 16A, may extend through, or may be disposed in channels integrally woven into or secured to the front section 16A. The securement of the proximal ends 58 and spacing of the apertures 62 ensures that portions of adjacent ones of the tensioning cables 56 between their proximal ends 58 and the apertures 62 do not overlap one another and are spaced apart from one another.

The fastening system 22 also includes a plurality of looped cables 64, best shown in FIGS. 1 and 3. The looped cables 64 have proximal ends 66 that are fixed to at least one of the front section 16A of the upper 16 or the sole structure 12 on the medial side 44 near the bite line 50. The plurality of tensioning cables 56 extend upward along the lateral side 42 of the front section 16A from the proximal ends 58, and the plurality of looped cables 64 extend upward on the medial side 44 of the front section 16A from the proximal ends 66.

Similarly to the tensioning cables 56, the looped cables 64 are disposed within the front section 16A near the proximal ends 66, or are at least inward of an outer surface 60 of the front section 16A until they emerge from the upper 16 at apertures 68 in the front section 16A, where looped ends 70 of the looped cables 64 extend out of the front section 16A, as best shown in FIG. 3. The looped cables 64 may be disposed between inner and outer layers of the body 30 of the front section 16A, or may be disposed in channels integrally woven into or secured to the front section 16A. The securement of the proximal ends 66 and spacing of the apertures 68 ensures that portions of adjacent ones of the looped cables 64 between the proximal ends 66 and the apertures 68 do not overlap one another and are spaced apart from one another. The looped end 70 may be a continuous loop of the looped cable 64, with two terminal ends of the cable at the proximal end 66. Alternatively, the looped end 70 may be achieved by stitching or tying two portions of the cable 64 to one another to form a loop, or by any other means of forming an aperture at the end of the cable 64.

As used herein, a "cable", such as any of the tensioning cables 56, or the looped cables 64, is a flexible, elongated tensile element, and is a structure capable of withstanding a tensile load and includes, but is not limited to, a lace, a strand, a wire, a cord, a thread, or a string, among others. The cables 56, 64 may be located to (a) resist stretching of the upper 16 in specific directions or locations, (b) limit excess movement of the foot relative to the sole structure 12 and the upper 16, (c) ensure that the foot remains properly positioned relative to the sole structure 12 and the upper 16, and/or (d) reinforce locations where forces are concentrated. As non-limiting examples, suitable materials for the cables 56, 64 include various filaments, fibers, yarns, threads, or ropes that are formed from rayon, polyamide, polyester, polyacrylic, silk, cotton, carbon, glass, aramids (e.g., para-aramid fibers and meta-aramid fibers), ultra-high molecular weight polyethylene, liquid crystal polymer, copper, aluminum, or steel.

With continued reference to FIG. 3, the plurality of tensioning cables 56 extends through the plurality of looped cables 64 between the proximal ends 58 of the plurality of tensioning cables 56 and distal ends 71 (shown in FIGS. 2 and 4) of the cables 56 which are secured to the proximal end 72 of the strap 40. When the distal end 52 of the strap 40 is secured to the front section 16A as shown in FIG. 1, the plurality of tensioning cables 56 turn in direction at the plurality of looped cables 64, doubling back toward the lateral side 42 from which they originated.

Multiple tensioning cables 56 may be routed together from their proximal ends 58 through the same aperture 62, and then through the same looped cable 64. For example, as best indicated in FIG. 3, two tensioning cables 56, indicated as 56A, 56B in FIG. 3, extend parallel and in contact with one another from proximal ends 58 to an aperture 62, and then emerge from the aperture 62. Stated differently, a pair of tensioning cables 56 extends out of each aperture 62, and the pair is routed together as described herein. By providing a pair through each aperture 62, greater tension may be applied, and any abrasion or wear that may occur as the cables 56 slide through the looped cables 64 during adjustment is distributed over the surface of both cables 56 of the pair. As used herein, "adjacent" ones of the tensioning cables 56 are tensioning cables 56 that extend out of adjacent apertures 62, or are looped cables 64 that extend out of adjacent apertures 68, not cables that extend out of the same aperture. For example, two or more tensioning cables 56 may extend out of each aperture 62. Similarly, two or more looped cables 64 may extend out of each aperture 68, with a tensioning cable 56 (or a pair of tensioning cables exiting from the same aperture 62) extending through each such looped cable 64 that extends from the same aperture 68.

The strap 40 has a proximal end 72 connected to the distal ends 71 of the plurality of tensioning cables 56. A webbed spacer 80 is secured to the plurality of tensioning cables 56 between the strap 40 and the looped cables 64. The plurality of tensioning cables 56 extends through the plurality of looped cables 64 between the proximal ends 58 of the plurality of tensioning cables 56 and the webbed spacer 80. The webbed spacer 80 includes webbing 82 that extends between adjacent ones of the plurality of tensioning cables 56, and the adjacent ones of the plurality of tensioning cables 56 are thus spaced apart from one another by the webbing 82 of the webbed spacer 80. The webbed spacer 80 thus helps to maintain even the exposed portions of the adjacent ones of the tensioning cables 56 apart from one another between the looped cables 64 and the strap 40, at least when the strap 40 is in the secured position of FIG. 1. By spreading adjacent ones of the tensioning cables 56 apart from one another, the webbed spacer 80 also helps to prevent tangling of the tensioning cables 56. The placement of the apertures 62 and of the looped cables 64, and the webbed spacer 80 work in conjunction to separate adjacent ones of the tensioning cables 56 between the apertures 62 and the strap 40. In addition to preventing tangling of adjacent ones of the tensioning cables 56, this also helps to maintain a resulting even distribution of tension over the cables 56, and an even distribution of pressure of the tightened body 30 over the foot in the area of the cables 56, 64, such as at the instep.

The webbed spacer 80 may be a flexible polymeric material. For example, the webbed spacer 80 may be elastically resilient (i.e., stretchable) inner and outer membrane-like layers 80A, 80B, which may be referred to as skins. Non-limiting examples of materials for the webbed spacer 80 include stretchable thermoplastic polyurethane, or relatively thin LYCRA® or SPANDEX® textile material, or composites including these materials, or other relatively thin, flexible materials including stretchable synthetic materials. Such materials allow the webbed spacer 80 to be relatively thin and flat, and able to conform to the shape of the outer surface 60 of the body 30 of the front section 16A against which it is disposed when the distal end 52 of the strap 40 is secured to the front section 16A as shown in FIGS. 1 and 2.

The inner layer 80A is depicted in FIG. 4, while the outer layer 80B is depicted in FIG. 2. To attach the webbed spacer 80 to the tensioning cables 56, the tensioning cables 56 are placed between the inner and outer layers 80A, 80B according to the desired spacing of adjacent tensioning cables 56. A hot melt film or other adhesive is also placed between the layers 80A, 80B, and the inner and outer layers 80A, 80B are then bonded together by a flat heat press process. The portions of the tensioning cables 56 at the webbed spacer 80 are thus completely covered by, secured to, and trapped between the layers 80A, 80B, and are fixed relative to the webbed spacer 80 such that they do not slide within the webbed spacer 80.

As best shown in FIGS. 2 and 4, the webbed spacer 80 is a quadrilateral shape, and may have either rounded or angled corners. None of the four sides of the webbed spacer 80 are parallel to one another. The distal edge 83 of the webbed spacer 80 is shorter than the proximal edge 85 of the webbed spacer 80. The webbed spacer 80 tapers in width from the proximal edge 85 to the distal edge 83. In accordance with the tapering of the webbed spacer 80, a respective spacing between each respective pair of adjacent tensioning cables 56, and the respective webbing 82 between each such pair, decreases along the webbed spacer 80 toward the strap 40 (i.e., from the proximal edge 85 to the distal edge 83. The width of the proximal edge 85 is narrower than the distance from a rearmost one of the looped cables 64 to a forward-most one of the looped cables 64, as is evident in FIG. 3. The webbed spacer 80 thus tapers to help gradually gather the adjacent tensioning cables 56 closer to one another and route the tensioning cables 56 from the more widely-spaced looped cables 64 to the distal ends 71 at the narrower strap 40.

The webbed spacer 80 is disposed and rests against the lateral side 42 of the front section 16A when the distal end 52 of the strap 40 is secured to the medial side 44 of the front section 16A (as shown in FIG. 3), with the plurality of tensioning cables 56 turning in direction at the plurality of looped cables 64. Because the webbed spacer 80 rests against the lateral side 42 of the front section 16A when the strap 40 is secured in this manner, the webbed spacer 80 may help prevent abrasion of the tensioning cables 56 under forces against the lateral side 42, especially in comparison to an embodiment without a webbed spacer.

As further discussed herein, fasteners 54 are disposed on the strap 40 and on the upper 16 to provide a desirable combination of support at both the medial side 44 and the lateral side 42 of the front section 16A, while still enabling adjustability in tightness and position of the strap 40. More specifically, fasteners 54 include fastening portions 54A, 54A1 on the strap 40 and fastening portions 54B1, 54B2 on the upper 16 that cooperate to help releasably secure the strap 40 to the front section 16A so that the strap 40 can maintain the rear section 16B in the use position. For example, as shown in FIG. 4, a first fastener portion 54A1 is secured to the inner side 96 of the strap 40 at the distal end 52 of the strap 40. A second fastener portion 54B1 is secured to the medial side 44 of the front section 16A, and a second fastener portion 54B2 is secured to the lateral side 42 of the front section 16A. The first fastener portion 54A is configured to secure to the second fastener portion 54B1. In the embodiment shown, the fasteners 54 are hook-and-loop fasteners, the first fastener portions 54A, 54A1 being hooks, and the second fastener portions 54B1, 54B2 being loops. Alternatively, the first fastener portions 54A, 54A1 could be loops, and the second fastener portions 54B1, 54B2 could be hooks, some of the first fastener portions 54A, 54A1 could be hooks and some could be loops, while some of the second fastener portions 54B1, 54B2 could be hooks and others could be loops, or one or more of the first fastener portions 54A, 54A1 could be a combination of hooks and loops, and one or more of the second fastener portions 54B1, 54B2 could be a combination of hooks and loops. Still further, other types of fasteners could be used, such as snaps, buttons, etc.

As best shown in FIG. 4, the strap 40 has a plurality of first fastener portions 54A spaced along the inner side 86 of the strap 40, which enables a greater variation in positioning of the strap 40 on the upper 16 in the secured state of the strap 40. Spacing multiple first fastener portions 54A along the strap 40 may allow greater stretch of the strap 40 between adjacent fastening portions 54A, if the material of the strap 40 has greater elasticity than the material of the fastener portions 54A. Stated differently, when pulled in tension, portions of the strap 40 between adjacent fastener portions 54A or 54A1 can stretch, whereas portions of the strap 40 at which the less elastic fastener portions 54A or 54A1 are secured will have less ability to stretch.

The front section 16A of the upper 16 has a second fastener portion 54B2 secured to the lateral side 42 of the front section 16A, and another second fastener portion 54B1 secured to the medial side 44 of the front section 16A. Although not shown, one or more additional second fastener portions could be secured to the exterior surface of the rear section 16B. The strap 40 is configured to wrap behind the rear section 16B from the lateral side 42 of the front section 16A to the medial side 44 of the front section 16A, and secure to second fastener portion 54B1 on the medial side 44 of the front section 16A when the rear section 16B is in the use position, as indicated in FIGS. 1 and 2. Some of the fastener portions 54A will secure to the second fastener portion 54B2.

The rear section 16B is movable relative to the front section 16A between the access position (FIG. 4) and the use position (FIGS. 1-3). As used herein, movable "between" the access position and the use position means that the rear section 16B may be moved from one of the positions to the other of the positions. As shown in FIG. 4, the rear section 16B is at least partially rearward of the front section 16A both in the access position and in the use position. The rear section 16B folds downward and rearward relative to the front section 16A at a fold region 46 to the access position to open the foot-receiving cavity 18 from the rear, enabling the foot 20 to be inserted in a forward and downward direction indicated by arrow A. The fold region 46 is spaced apart from the sole structure 12 in the embodiment shown, as best indicated in FIG. 4. Alternatively, the rear section 16B may fold relative to the front section 16A closer to the sole structure 12, such as at the bite line 50 between the sole structure 12 and the upper 16 to provide even greater access to the foot-receiving cavity 18 from the rear. The foot-receiving cavity 18 is exposed at the heel region of the footwear 10 when the rear section 16B is in the access position, and the rear section 16B partially encloses the heel region 28 when the rear section 16B is in the use position. The foot 20 itself may spread the lateral and medial sides 42, 44 of the front section 16A further apart from one another along a transverse axis during foot insertion (i.e., in an outward direction, perpendicular to the longitudinal mid-line)), as needed to accommodate the girth of the foot 20 and ankle.

As shown in FIGS. 1-2, when the rear section 16B is in the use position, a rear medial edge 93 of the front section 16A interfaces with the rear section 16B at a medial side interface 84, and a rear lateral edge 95 of the front section 16A interfaces with the rear section 16B at a lateral side interface 86. The fastener portions 54B1, 54B2 on the medial side 44 and the lateral side 42 of the front section 16A border the medial side interface 84 and the lateral side interface 86, respectively. The strap 40 crosses over the medial side interface 84 and the lateral side interface 86 when the rear section 16B is in the use position, and the plurality of fastener portions 54A, 54A1 of the strap 40 are secured to the medial side fastener portion 54B1 (FIG. 1), and to the lateral side fastener portion 54B2 (FIG. 2).

The rear section 16B articulates from the use position to the access position by folding rearward. In such an embodiment, a forward medial edge 97 of the rear section 16B is nearer to the rear medial edge 93 of the front section 16A when the rear section 16B is in the use position than when the rear section 16B is in the access position, and a forward lateral edge 99 of the rear section 16B is nearer to the rear lateral edge 95 of the front section 16A when the rear section 16B is in the use position than when the rear section 16B is in the access position. Depending upon the girth of the foot 20 and ankle when the foot 20 is inserted into the foot-receiving cavity 18, the use position of the rear section 16B may be slightly more forward or rearward relative to the front section 16A, but in all cases, is more forward than the access position. For example, for an ankle of relatively small girth, the forward medial edge 97 of the rear section 16B may be forward and inward of the rear medial edge 93 of the front section 16A when the rear section 16B is in the use position, and the forward lateral edge 99 of the rear section 16B may be forward and inward of the rear lateral edge 95 of the front section 16A when the rear section 16B is in the use position. In other words, the rear section 16B folds slightly more forward and inward of the front section 16A than shown in FIG. 1, similar to a shoe tongue relative to medial and lateral sides of an upper. In contrast, for a foot 20 and ankle of relatively large girth, the forward medial edge 97 of the rear section 16B is further rearward of the rear medial edge 93 of the front section 16A when the rear section 16B is in the use position, and the forward lateral edge 99 of the rear section 16B is slightly more rearward of the rear lateral edge 95 of the front section 16A than shown in FIG. 1 when the rear section 16B is in the use position. In each of these cases, the rear section 16B is still held in the use position by the strap 40.

The front and rear sections 16A, 16B may be configured to help avoid a tendency of the front section 16A to collapse during foot insertion under the force of a foot that is slightly misaligned with the foot-receiving cavity 18. For example, the rear medial edge 93 and the rear lateral edge 95 are substantially vertical and entirely in the heel region 28 of the footwear 10. This arrangement may provide greater resistance to crush and collapse of the front section 16A than would more forwardly-angled rear medial and lateral edges during a misdirected foot insertion.

FIGS. 5-12 shown an alternative embodiment of an article of footwear 110 within the scope of the present teachings. The article of footwear 110 has many of the same features as the article of footwear 10, which are configured and function as described with respect to the article of footwear 10, and are indicated with like reference numbers. The article of footwear 110 has a different arrangement of second fastener portions 154B, has a slightly different front section 116A and a different articulating rear section 116B, and has sets of magnetic elements that provide a magnetic coupling of the rear section 116B to the front section 16A when the rear section 116B is in the use position.

Figure 11:
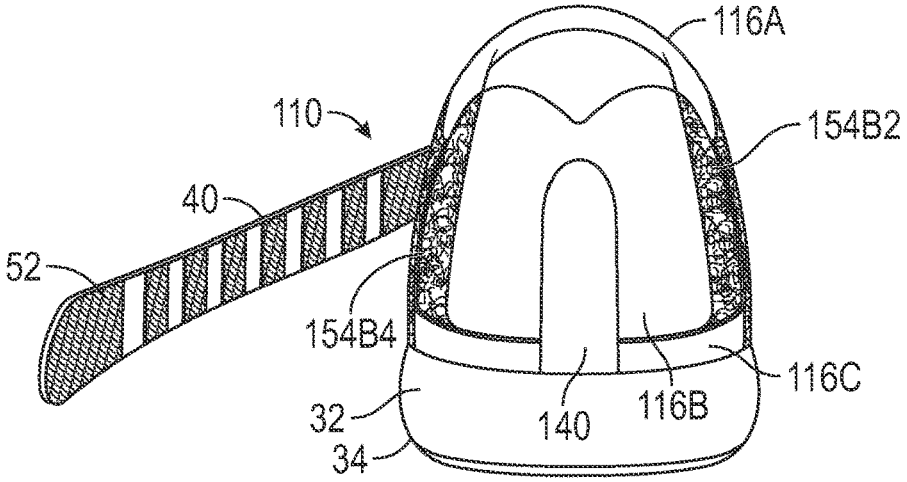
FIG. 11 is a schematic illustration in rear view of the article of footwear of FIG. 5 with the strap in an unsecured position and the rear section in the use position.
Figure 12:
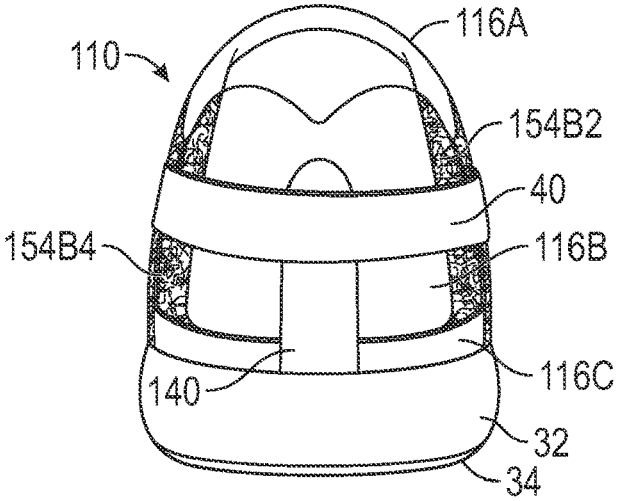
FIG. 12 is a schematic illustration in rear view of the article of footwear of FIG. 5 with the strap in a secured position and the rear section in the use position.

The article of footwear 110 has a front section 116A that is configured as a mule, as it includes a mule portion 116C that extends around a rear of the heel region 28 from the lateral side 42 to the medial side 44, as best indicated in FIGS. 9, 11, and 12. A tether 140 couples the rear section 116B to the front section 116A. For example, the tether 140 may be stitched or otherwise secured to the front section 116A at one end of the tether 140, and to the rear section 116B at the other end of the tether 140. The tether 140 is a flexible, elongated structure capable of withstanding a tensile load. The tether 140 may be, for example, a material such as a woven polymer. The tether 140 can comprise any one of, or a plurality of, or any combination of two or more selected from among the following: a strap, a cord, a filament, a strand, a ribbon, a tube, a braid, a strip, a cable, a lace, a belt, a string, a thread, a rope, a wire, and a web. The tether 140 is inelastic or has an elasticity that is sufficiently low such that any increase in length of the tether 140 when under tension (i.e., stretching of the tether 140) is minimal.

Figure 5:
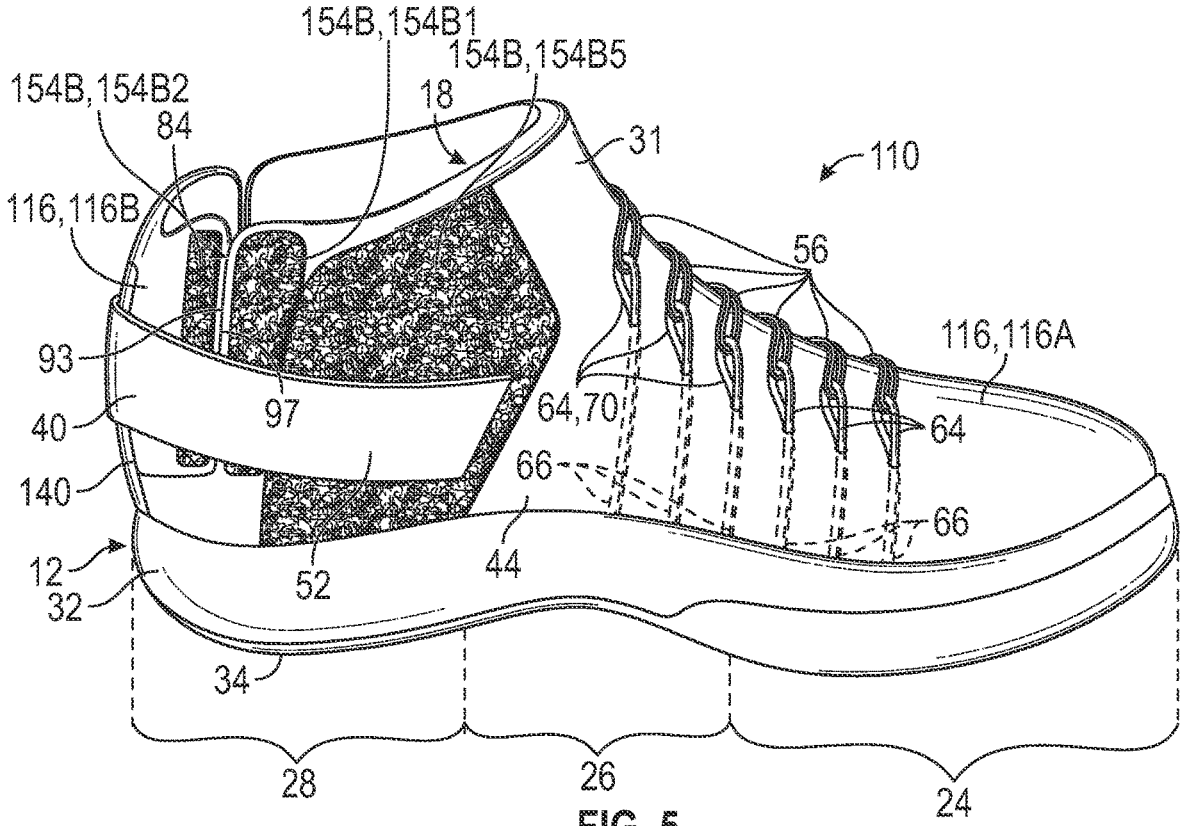
FIG. 5 is a schematic illustration in perspective medial side view of an article of footwear with a distal end of a strap secured to a rear section of the upper in a use position, in accordance with an alternative aspect of the present teachings.
Figure 6:
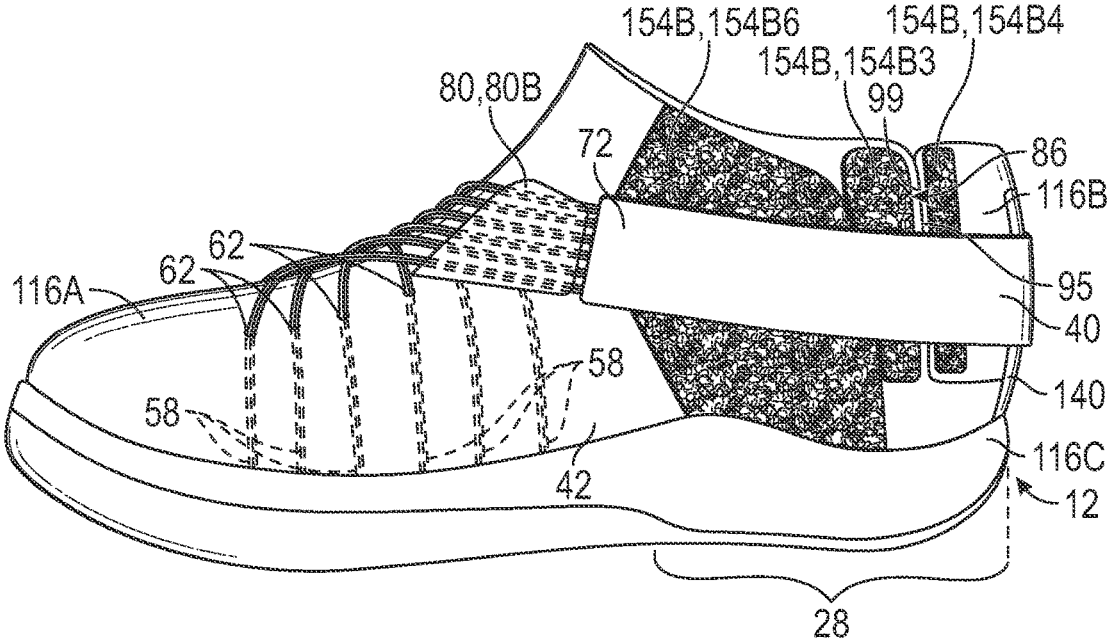
FIG. 6 is a schematic illustration in lateral side view of the article of footwear of FIG. 5.
Figure 7:
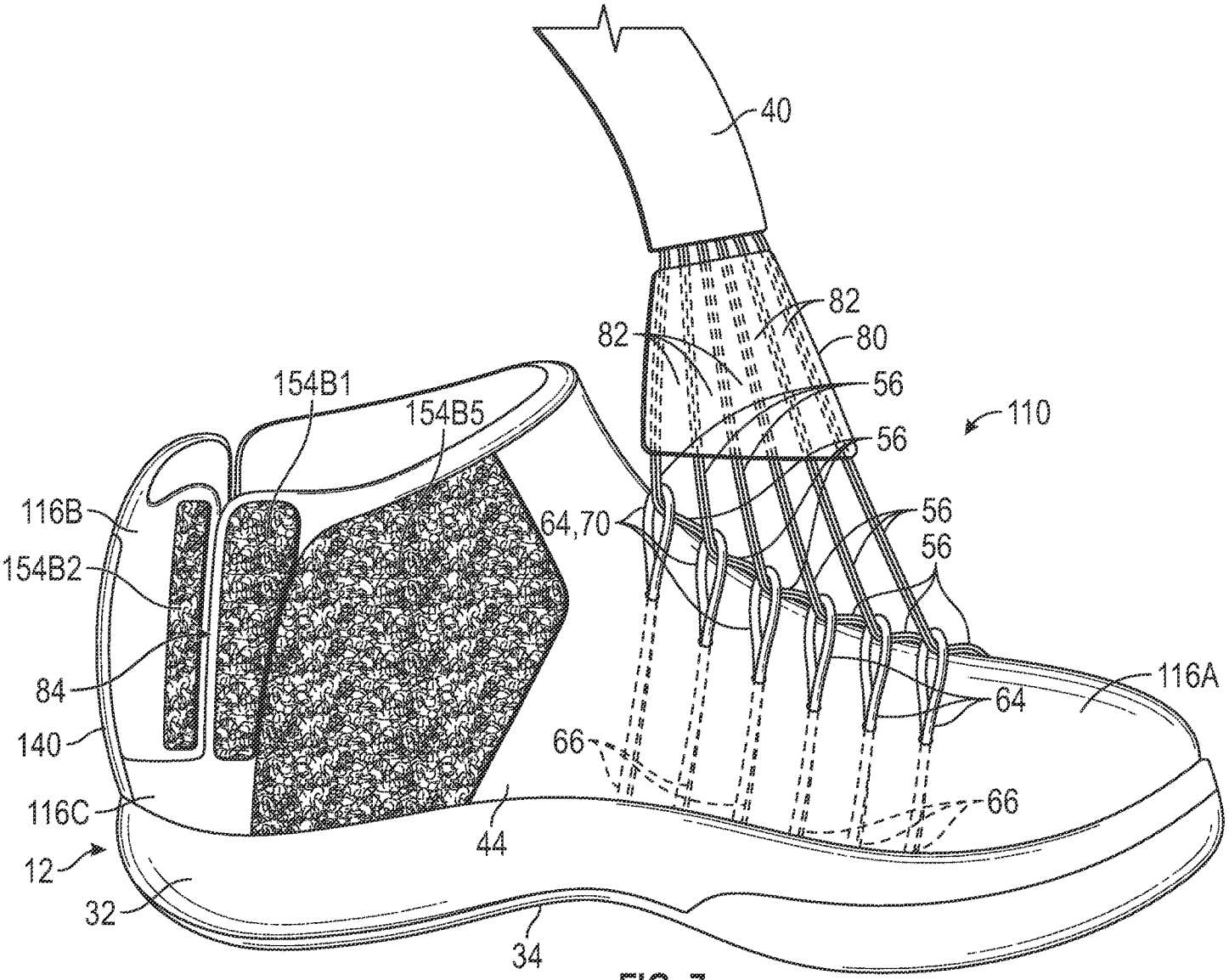
FIG. 7 is a schematic illustration in perspective medial side view of the article of footwear of FIG. 5 with the strap in partial fragmentary view and in an unsecured position, and the rear section of the upper in the use position.
Figure 8:
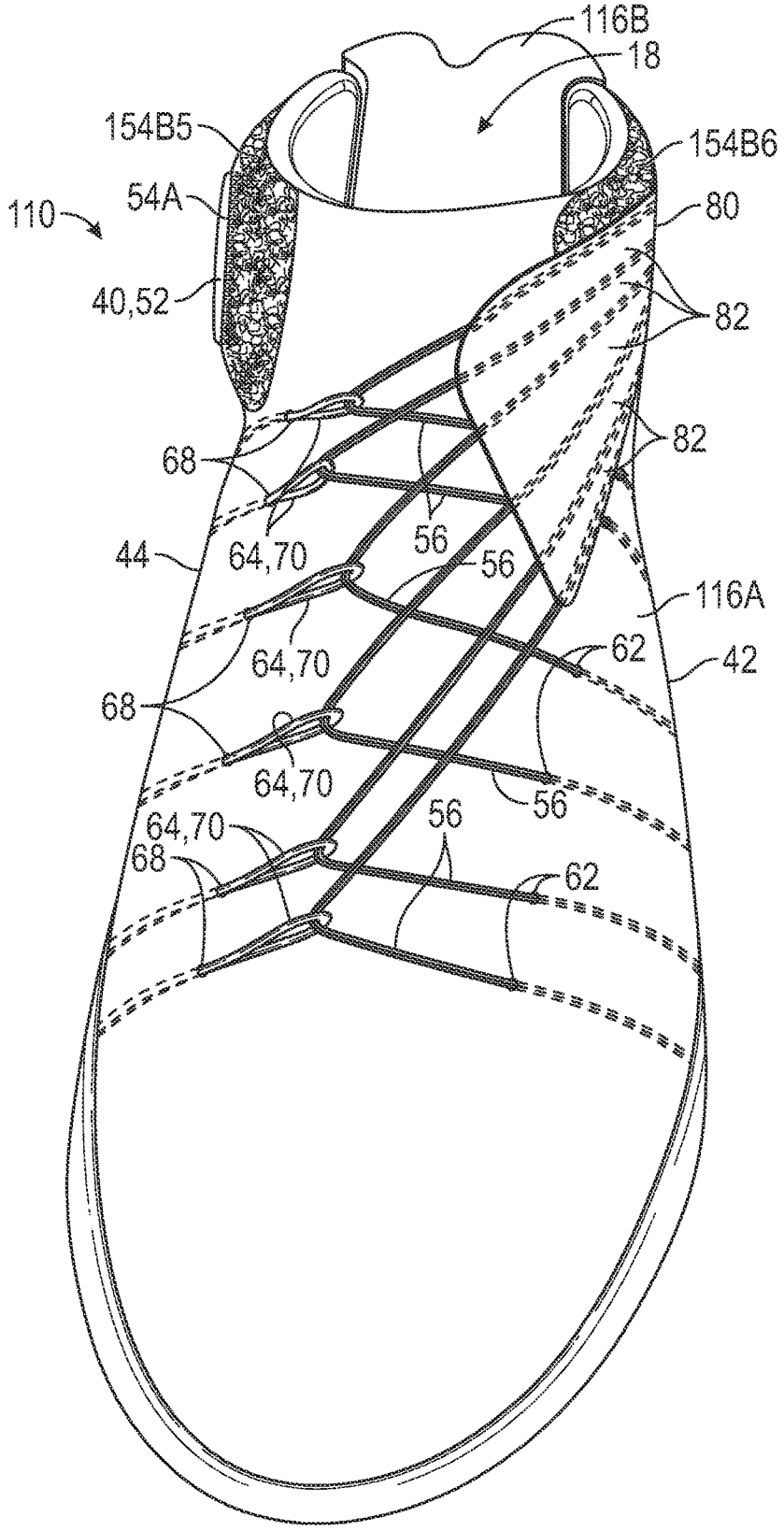
FIG. 8 is a schematic illustration in front perspective view of the article of footwear of FIG. 5.

The fastener portions 154B are particularly placed on the front section 116A and the rear section 116B to aid in maintaining the rear section 116B in the use position. As best shown in FIGS. 5 and 6, in the use position, the rear medial edge 93 of the front section 116A interfaces with the forward medial edge 97 of the rear section 116B at the medial side interface 84, and the rear lateral edge 95 of the front section 116A interfaces with the front lateral edge 99 of the rear section 116B at the lateral side interface 86. The front medial edge 97 and the front lateral edge 99 of the rear section 116B are spaced apart from the rear medial edge 93 and rear lateral edge 95 of the front section 116A in the access position, however, as best shown in FIG. 9.

The plurality of fastener portions 154B of the upper include a front section medial side fastener portion 154B1 and a rear section medial side fastener portion 154B2, both bordering the medial side interface 84 (see FIG. 5) when the rear section 116B is in the use position, and further include a front section lateral side fastener portion 154B3, and a rear section lateral side fastener portion 154B4, both bordering the lateral side interface 86 (see FIG. 6) when the rear section 116B is in the use position. The strap 40 crosses over the medial side interface 84 and the lateral side interface 86 when the rear section 116B is in the use position, and the plurality of fastener portions 54A of the strap 40 (best shown in FIG. 9) are secured to the front section medial side fastener portion 154B1, to the rear section medial side fastener portion 154B2, to the front section lateral side fastener portion 154B3, and to the rear section lateral side fastener portion 154B4. Additional fastener portions 154B5 and 154B6 are further forward on the front section 116A, and the fastener portions 54A also secure to these.

In addition to the strap 40 mechanically coupling the rear section 116B to the front section 116A in the use position, the rear section 116B is also magnetically coupled to the front section 116A when in the use position. More specifically, the article of footwear 110 includes a forward medial set of magnetic elements 90A secured within the front section 116A at the medial side 44 of the front section 116A near the rear medial edge 93 (see FIG. 10), and a rear medial set of magnetic elements 90B secured within the rear section 116B at the medial side of the rear section 116B near the forward medial edge 97 (see FIG. 9). A forward lateral set of magnetic elements 92A is secured within the front section 116A at the lateral side 42 of the front section 116A near the rear lateral edge 95 (see FIG. 10), and a rear lateral set of magnetic elements 92B is secured within the rear section 116B at the lateral side of the rear section 116B near the forward lateral edge 99. The magnetic elements may be sewn or otherwise secured within the respective sections 116A, 116B. Although four magnetic elements are shown within each of the sets 90A, 90B, 92A, 92B, each set may have only one magnet, or may have any different number of magnetic elements. The magnetic elements 90A, 92A, 90B, 92B either have magnetic energy or are attracted to magnetic energy (i.e., are either a ferrous material or magnetic material in any combination so that the magnetic elements 90A are attracted to the magnetic elements 90B, and the magnetic elements 92A are attracted to the magnetic elements 92B.

The rear section 116B is secured to the front section 116A in the use position at least partially by a magnetic coupling of the forward medial set of magnetic elements 90A to the rear medial set of magnetic elements 90B across the medial side interface 84, and by a magnetic coupling of the forward lateral set of magnetic elements 92A to the rear lateral set of magnetic elements 92B across the lateral side interface 86. The sets of magnetic elements 90A, 90B, 92A, 92B may be disposed within housings that are inserted within the respective sections 116A, 116B of the upper 116, or may be inserted without a housing. The sets of magnetic elements 90A, 90B, 92A, 92B and any housings for the sets of magnetic elements may help provide greater support to the foot in the heel region 28 at the medial and lateral sides 44, 42 when the rear section 116B is in the use position, especially when the medial and lateral side interfaces 84, 86 are substantially vertical and entirely in the heel region 28 of the article of footwear 110 as shown in FIGS. 5-6. As discussed with respect to the article of footwear 10, the substantially vertical orientation of the rear medial and lateral edges 93, 95 of the front section 116A may help to prevent collapsing of the front section 116A when a foot 20 is misaligned with the foot-receiving cavity 18 during foot insertion. The sets of magnetic elements 90A, 92A and any housings in which they may reside, since these are disposed near the edges 93, 95 will also help maintain the edges 93, 95 in an upright orientation during foot insertion to help keep the foot-receiving cavity 18 open at the heel region 28 during foot insertion.

While the magnetic elements are selected to be of sufficient magnetic strength to help pull the rear section 116B to the use position as it is being moved to the use position and maintain the rear section 116B in the use position during some activities, the magnetic force is also low enough to enable the rear section 116B to be returned to the access position when removal of the footwear 110 is desired by pulling the rear section 116B backward, either manually or by force downward and rearward on the top of the rear section 116B using the opposite foot, without requiring excessive force.

Figure 13:
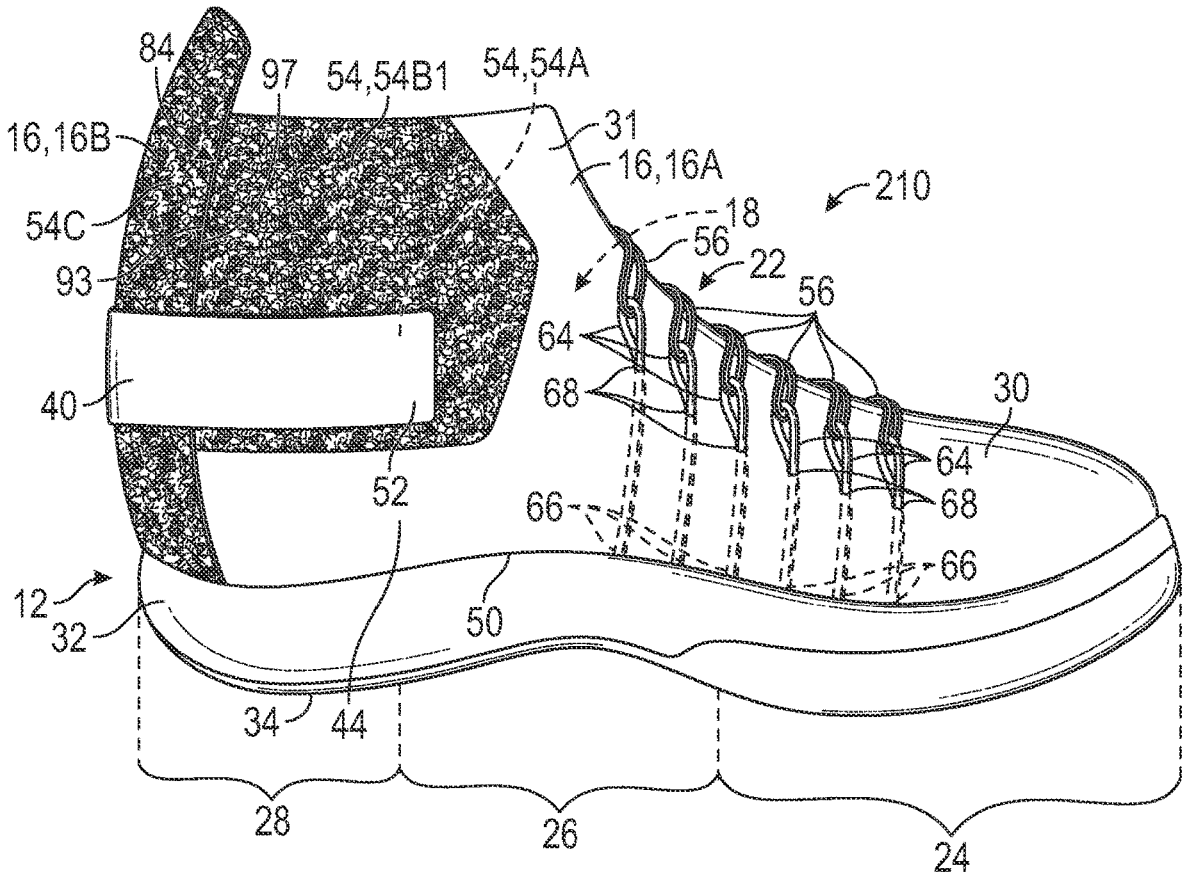
FIG. 13 is a schematic illustration in medial side view of an article of footwear with a distal end of a strap secured to a rear section of the upper in a use position, in accordance with an alternative aspect of the present teachings.

FIG. 13 shows an alternative embodiment of an article of footwear 210 that is alike in all aspects to article of footwear 10 of FIG. 1, except that a fastener portion 54C extends along an entire outer surface of the rear section 16B from a medial edge to a lateral edge and along all of or substantially all of the rear section 16B along its height from the sole structure 12 upward. This allows greater variation in placement of the strap 40 and/or increases the securement of the strap 40 to the rear section 16B.

Figure 14:
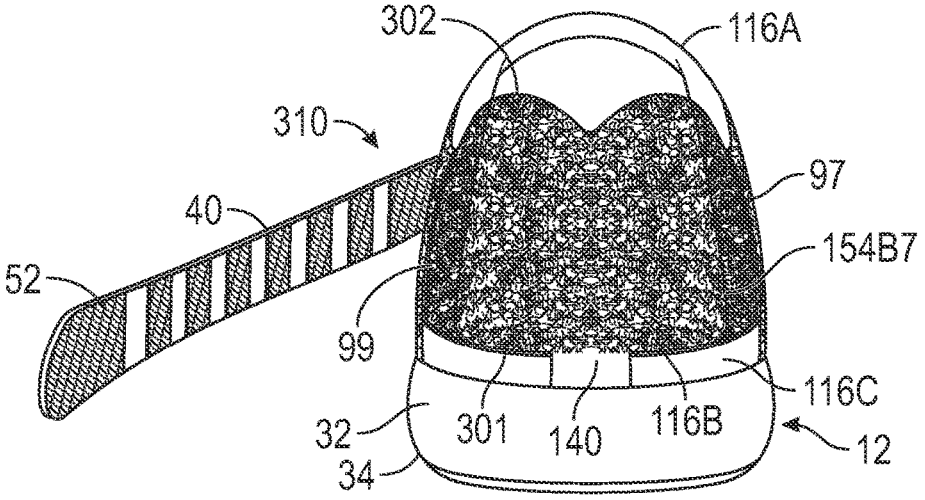
FIG. 14 is a schematic illustration in rear view of an article of footwear with a strap in an unsecured position and a rear section in the use position, in accordance with an alternative aspect of the present teachings.
Figure 15:
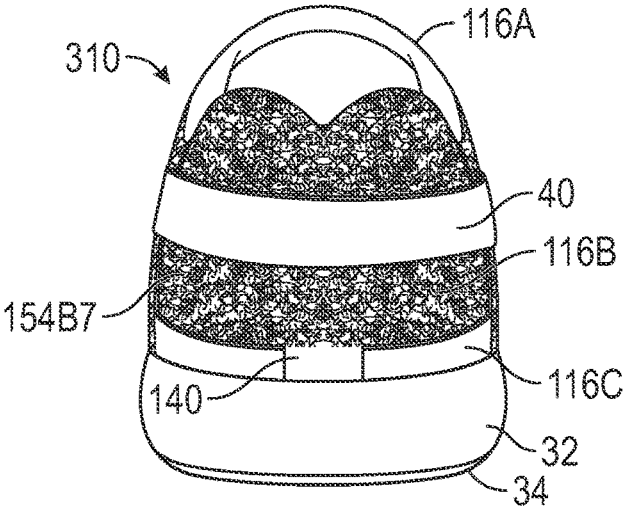
FIG. 15 is a schematic illustration in rear view of the article of footwear of FIG. 14 with the strap in a secured position and the rear section in the use position.

Similarly, FIGS. 14 and 15 show an article of footwear 310 that is alike in all aspects to the article of footwear 110 of FIG. 5 except that the rear section medial side fastener portion 154B2 and the rear section lateral side fastener portion 154B4 are replaced with a rear fastener portion 154B7 that extends along an entire outer surface of the rear section 116B from the forward medial edge 97 to the forward lateral edge 99 of the rear section 116B and along all of or substantially all of the rear section 116B along its height from its lower edge 301 to its upper edge 302 and over the tether 140.

FIGS. 16-20 show an article of footwear 410 that is alike in all aspects to the article of footwear 210, except that the article of footwear 410 also includes a medial-side flap 443 secured to a medial side wall 45 of the sole structure 12 and extending upward along the medial side 44 of the upper 16 in the midfoot region 26 of the article of footwear 410. Alternatively, the medial-side flap 443 could be secured between the upper 16 and the sole structure 12 at the bite line 50. In either example, the medial-side flap 443 is referred to as being secured at the medial side wall 45. The medial-side flap 443 is thicker and less elastic than the body 30, although flexible enough to generally conform to the outer contours of a foot within the foot-receiving cavity 18. By anchoring the medial-side flap 443 to the side wall 45, a foot in the foot-receiving cavity 18 may be more firmly held in place relative to the sole structure 12 under transverse forces, such as during cutting moves.

The looped cables 64 extend through the body 30 of the upper 16 and out through apertures 68 as previously described. The tensioning cables 56 extend through the upper 16, 30 on the lateral side 42 and out of apertures 62 as previously described. A webbed spacer 480 is secured to the tensioning cables 56 between the looped cables 64 and the distal ends 71 that are secured to the strap 40. The webbed spacer 480 is slightly larger than the webbed spacer 80 of FIG. 2, but otherwise has some the same function and features. The medial-side flap 443 is fixed to the proximal end of the webbed spacer 480. The webbed spacer 480 extends between adjacent ones of the plurality of tensioning cables 56 such that the adjacent ones of the plurality of tensioning cables 56 are spaced apart from one another by the webbed spacer 480. The webbed spacer 480 rests against the lateral side 42 of the front section 16A of the upper 16 when the distal end 52 of the strap 40 is secured to the upper 16 as shown in FIGS. 16 and 17.

Figure 20:
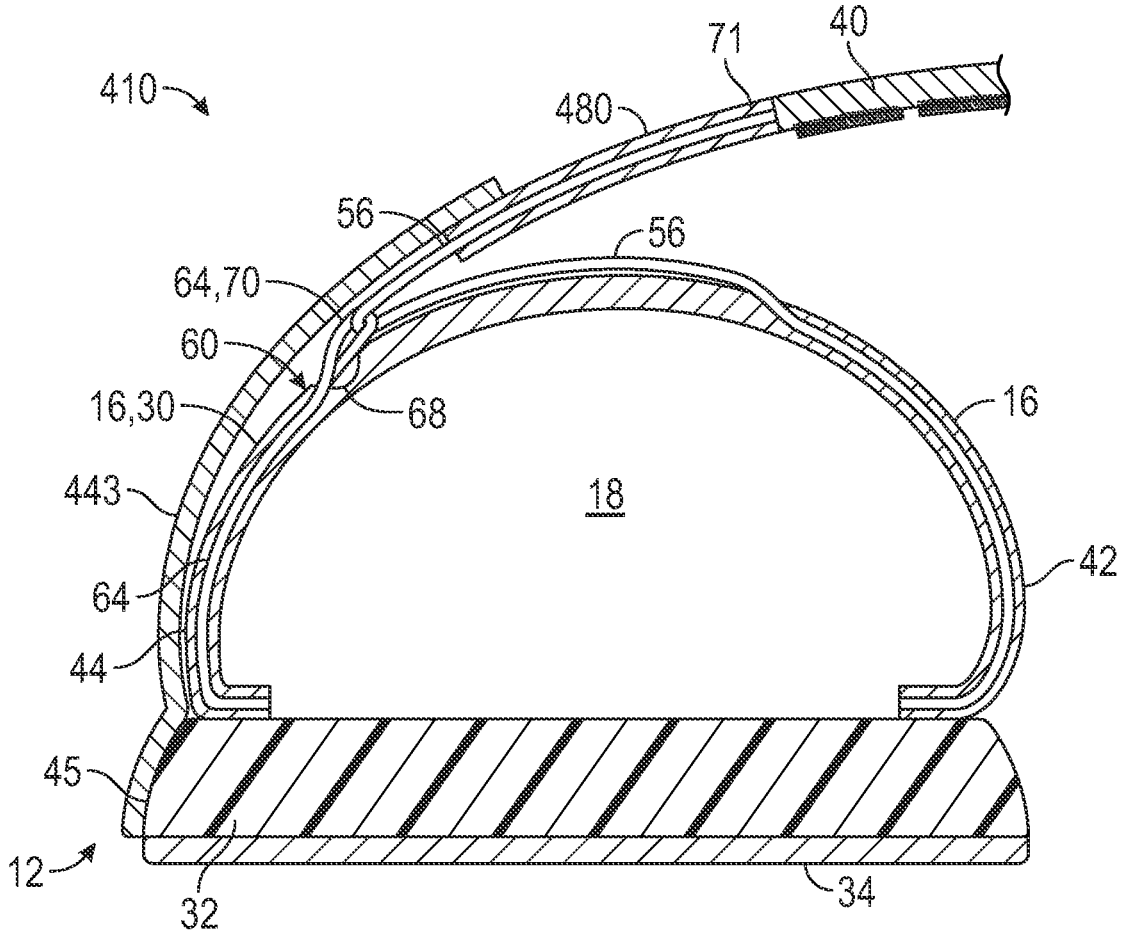
FIG. 20 is a schematic illustration in cross-sectional view of the article of footwear of FIG. 18 taken at lines 20-20 in FIG. 18.

The medial-side flap 443 lays against the outer surface 60 of the upper 16 and covers at least some of the plurality of looped cables 64 when the strap 40 is secured to the upper 16. In FIG. 20, the medial-side flap 443 is shown slightly spaced apart from the outer surface 60 in order to depict that it is not secured to the outer surface 60 or to the body 30. Additionally, the strap 40 is shown lifted to better depict the components. However, when the strap 40 is secured as in FIG. 16, the medial-side flap 443 rests against the outer surface 60. The stiffer, less elastic quality of the medial-side flap 443 provides support to the medial side of the foot especially at the arch when the strap 40 is pulled tight and fastened to the upper 16 as described.

Figure 16:
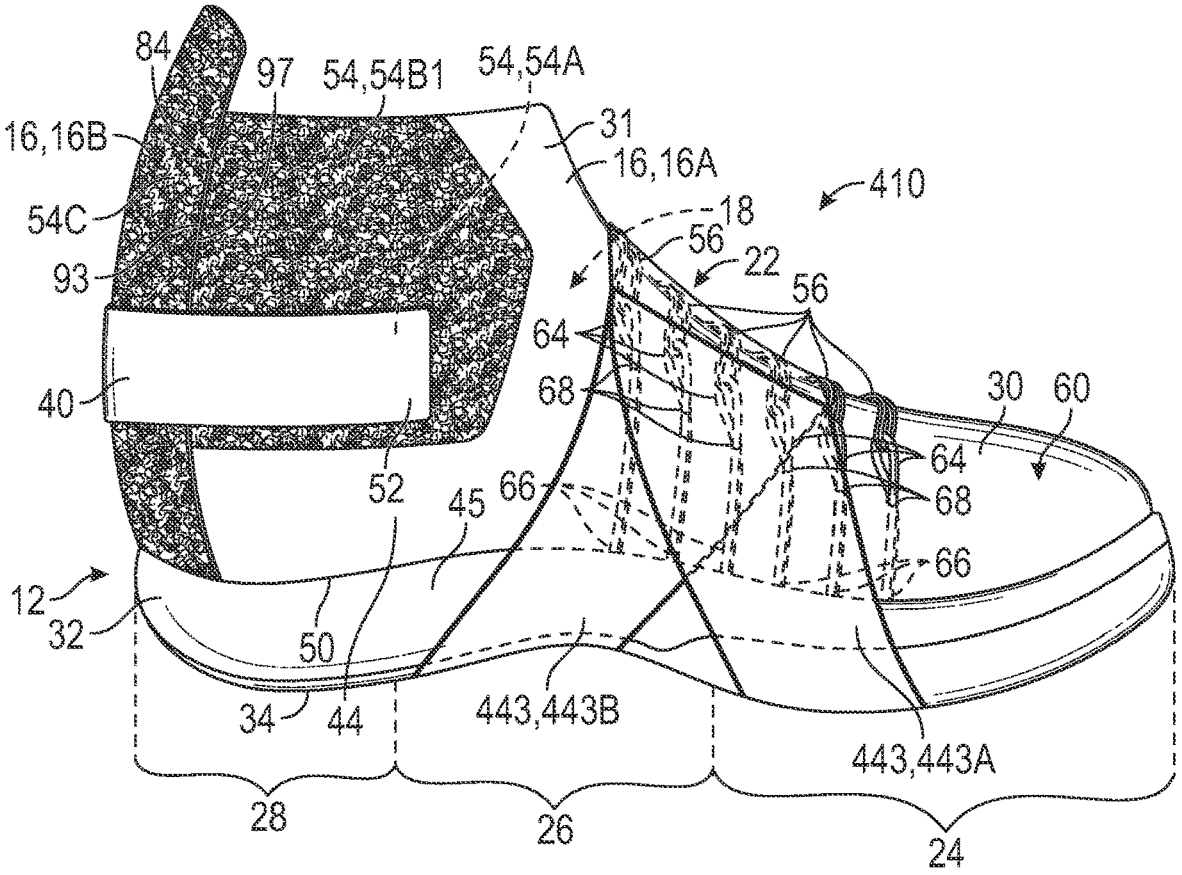
FIG. 16 is a schematic illustration in medial side view of an article of footwear with a medial-side flap and with a distal end of a strap secured to a front section of an upper and with a rear section of the upper in a use position, in accordance with an alternative aspect of the present teachings.
Figure 17:
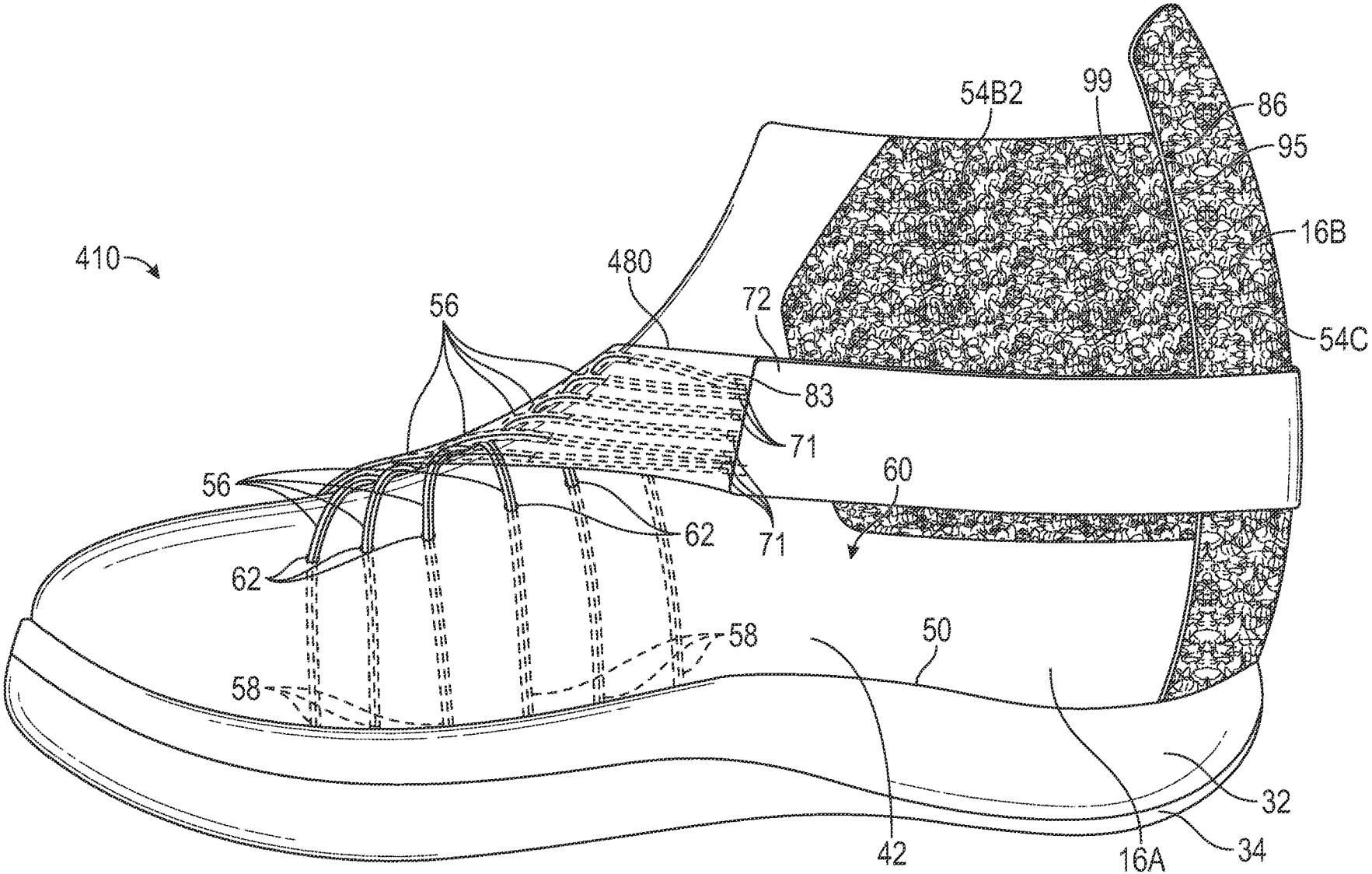
FIG. 17 is a schematic illustration in lateral side view of the article of footwear of FIG. 16.
Figure 18:
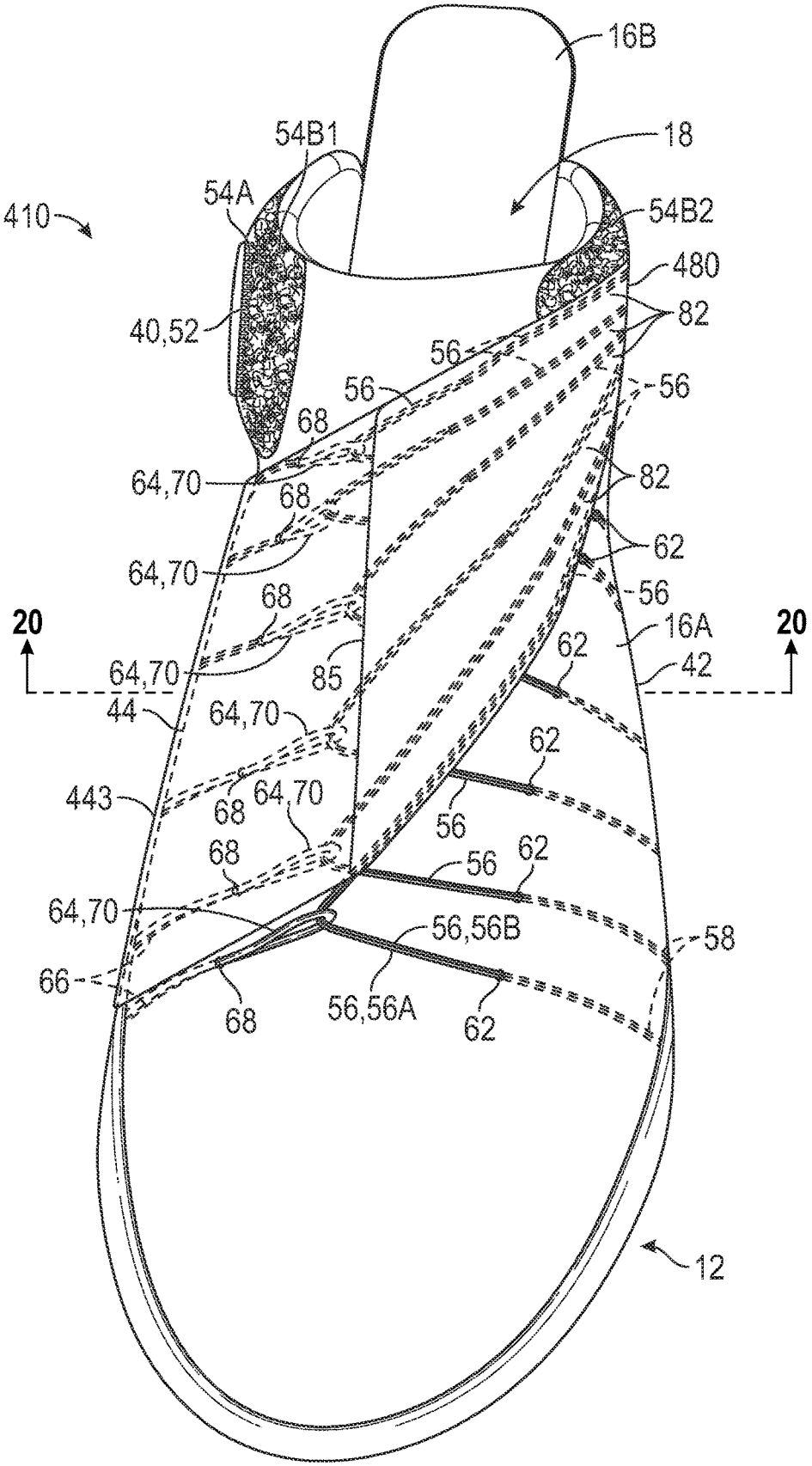
FIG. 18 is a schematic illustration in front perspective view of the article of footwear of FIG. 16.
Figure 19:
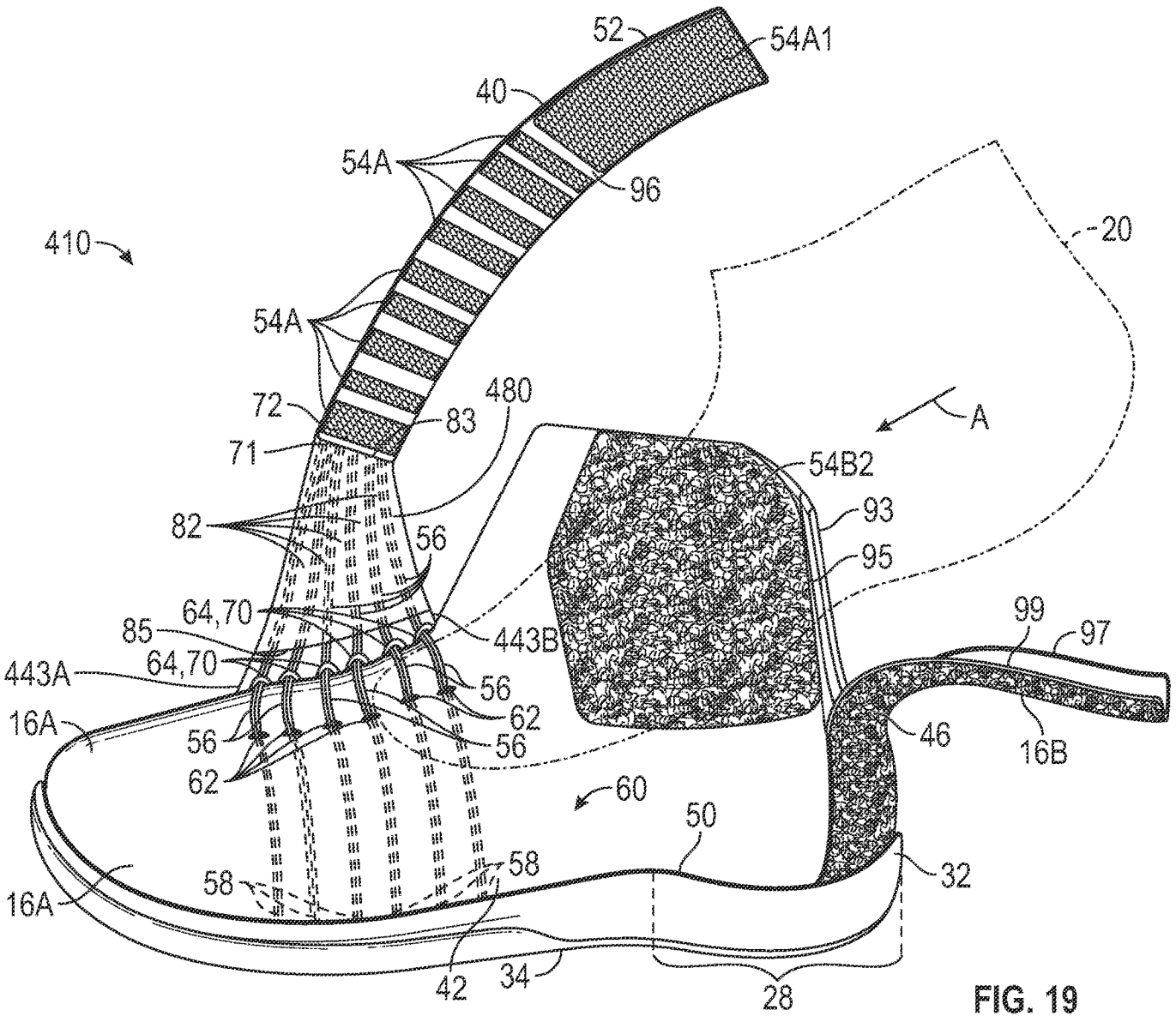
FIG. 19 is a schematic illustration in perspective lateral side view of the article of footwear of FIG. 16 with the distal end of the strap in an unsecured position, and a rear section of the upper in an access position.

As best shown in FIG. 16, the medial-side flap 443 is configured with a first portion 443A that extends rearwardly and upwardly from the sole structure 12, and with a second portion 443B that extends forwardly and upwardly from the sole structure 12 and is at least partially rearward of the first portion 443A at the sole structure.

Figure 21:
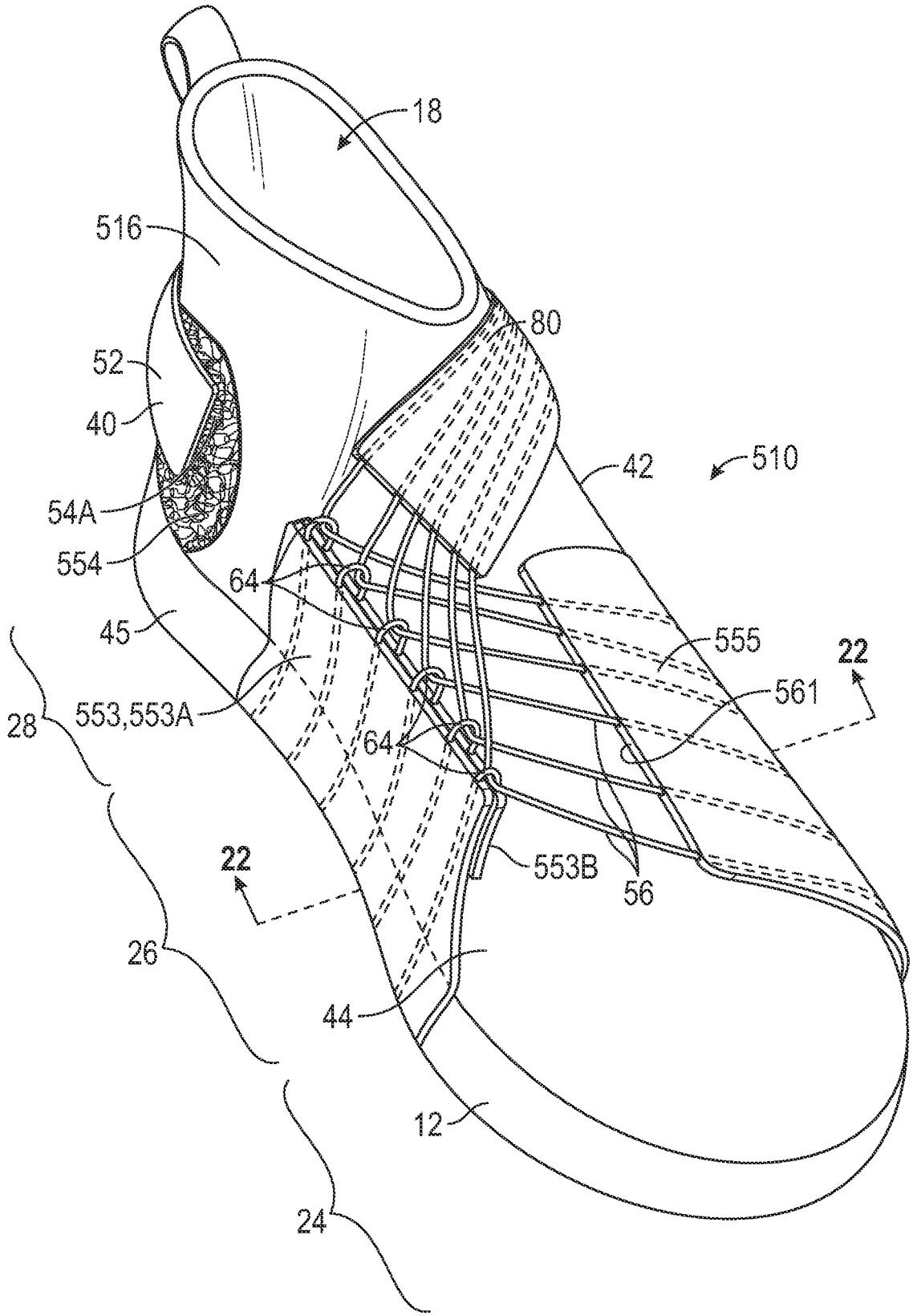
FIG. 21 is a schematic perspective illustration of an article of footwear with a distal end of a strap secured to an upper, in accordance with an alternative aspect of the present teachings.
Figure 22:
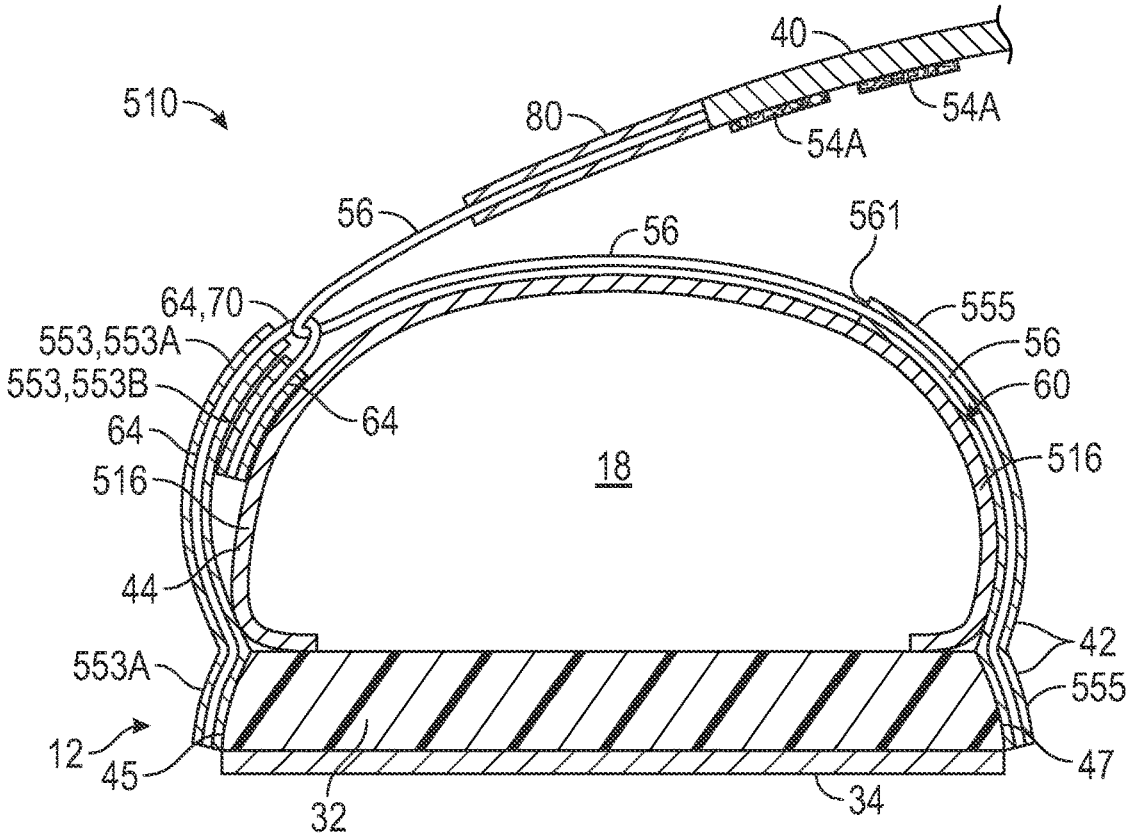
FIG. 22 is a schematic illustration in cross-sectional view of the article of footwear of FIG. 21 taken at lines 22-22 in FIG. 21.
Figure 23:
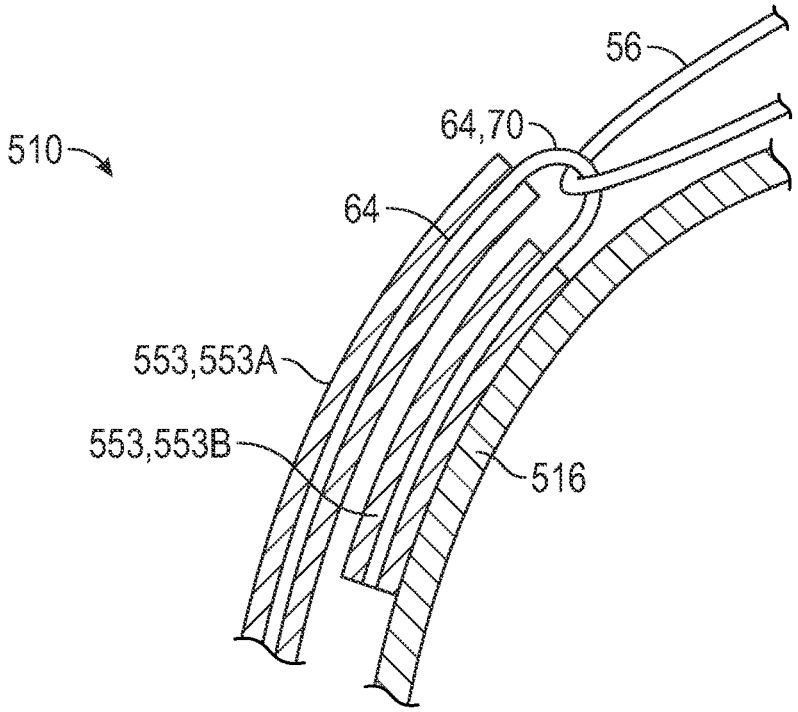
FIG. 23 is a schematic illustration in close-up fragmentary view of a portion of the article of footwear of FIG. 21.

FIGS. 21-23 show another embodiment of an article of footwear 510 that has many of the same features that function in the same manner as the article of footwear 10, including a webbed spacer 80, a strap 40, tensioning cables 56 and looped cables 64. The upper 516 is depicted as unitary rather than having a front section and an articulating rear section. The heel portion of the upper 516 includes one or more fastener portions 554 to which the fastener portions 54A, 54A1 of the strap 40 secure. The fastener portion 554 shown in FIG. 21 may extend around the rear of the upper 516 to the lateral side 42. In an alternative embodiment, the upper 16 could be used in the article of footwear 510.

A two-piece medial-side flap 553 is included in the article of footwear 510. For example, the medial-side flap 553 includes an outer medial-side flap 553A through which the looped cables 64 extend. Stated differently, the looped cables 64 extend through the outer medial-side flap 553A rather than through the upper 516. The outer medial-side flap 553A is secured to the medial side wall 45 of the sole structure 12 and extends upward along the medial side 44 of the upper 516 in the midfoot region 26 of the article of footwear 510. Alternatively, the medial-side flap 553A could be secured between the upper 516 and the sole structure 12 at the bite line 50. In either example, the medial-side flap 553A is referred to as being secured at the medial side wall 45. The medial-side flap 553 further includes an inner medial-side flap 553B that is secured to the medial side 44 of the upper 516 and disposed between the upper 516 and the outer medial-side flap 553A. The inner medial-side flap 553A extends only partway down the medial side 44 and is not movable relative to the medial side 44 as is the outer medial-side flap 553A when the strap 40 is pulled tight.

Neither the inner medial-side flap 553B nor the outer medial-side flap 553B is fixed to the proximal end of the webbed spacer 480. Due to the inner medial-side flap 553A, tensioning of the tensioning cables 56 pulls the medial side 44 of the upper 516 upward as well as against a foot in the foot-receiving cavity 18. The outer and inner medial-side flaps 553A, 553B are thicker and less elastic than the body of the upper 516, although flexible enough to generally conform to the outer contours of a foot within the foot-receiving cavity 18.

The looped cables 64 extend from the inner medial-side flap 553B to the outer medial-side flap 553A. As best shown in FIG. 23, the looped cables 64 are disposed between inner and outer layers of each of the outer medial-side flap 553A and the inner medial-side flap 553B, or may extend through or be disposed in channels integrally woven into or secured to the outer medial-side flap 553A and the inner medial-side flap 553B.

As shown in FIGS. 21-22, the article of footwear 510 further includes a lateral-side flap 555 that is secured to the lateral side 42 of the sole structure 12 and extends upward along the lateral side 42 of the upper 516 in the midfoot region 26 of the article of footwear 510. The lateral-side flap 555 is shown secured to a lateral side wall 47 of the sole structure 12, but may instead be secured between the upper 516 and the sole structure 12 at the bite line 50. In either example, the lateral-side flap 555 is referred to as being secured at the lateral side wall 47. Each of the plurality of tensioning cables 56 is secured to the lateral-side flap 555 and extends outward from a free edge 561 of the lateral side flap 555. As best shown in FIG. 22, the tensioning cables 56 extend through the lateral-side flap 555 in any of the same manners that the looped cables 64 extend through the outer medial-side flap 553A. Pulling the strap 40 to tension the tensioning cables 56 will thus pull the lateral-side flap 555 against the upper 516 as well as pulling the inner medial-side flap 553B against the upper 516. The lateral-side flap 555 is secured to the lateral side wall 47, but is not secured the upper 516, and is shown slightly displaced from the upper 516 in FIG. 22 in order to illustrate this. The lateral-side flap 555 rests against the outer surface 60 of the upper 516 when the tensioning cables 56 are pulled tight, however.

Figure 24:
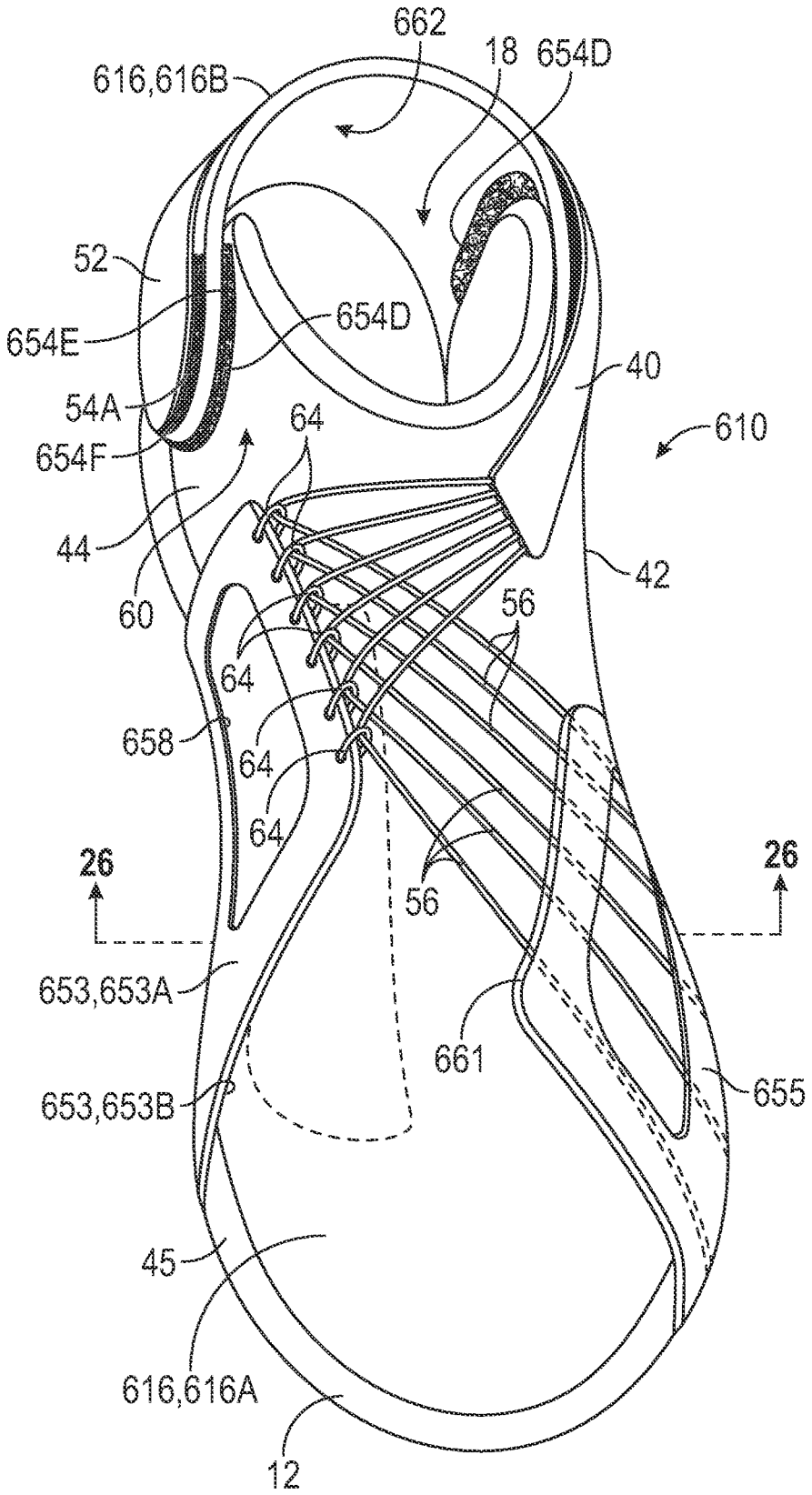
FIG. 24 is a schematic perspective illustration of an article of footwear to a with a distal end of a strap secured to a rear section of an upper, with the rear section of the upper in a use position and secured to a front section of the upper, in accordance with an alternative aspect of the present teachings.
Figure 25:
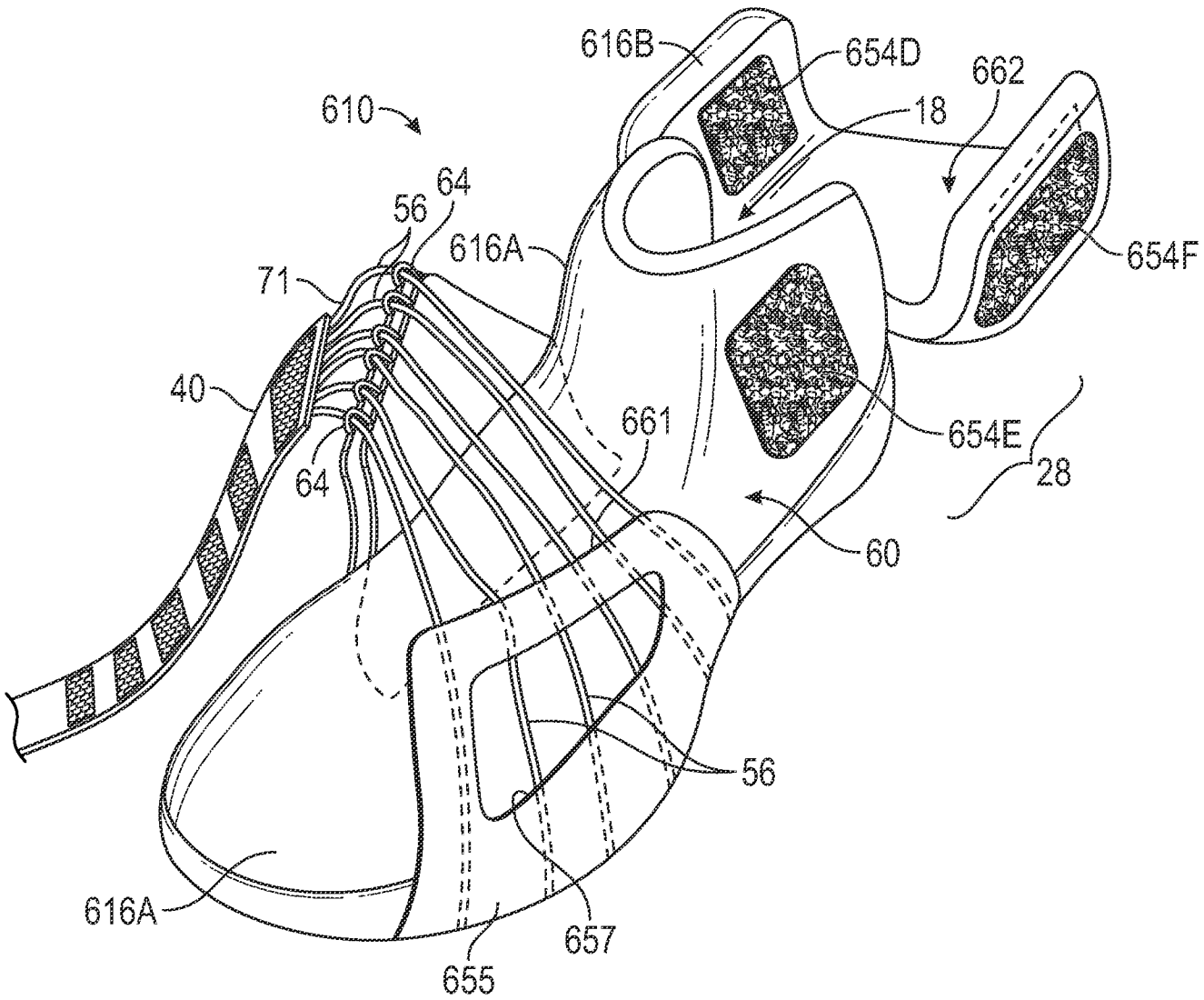
FIG. 25 is a schematic lateral perspective illustration of the article of footwear of FIG. 24 with the strap in an unsecured position and with the rear section in an access position.
Figure 26:
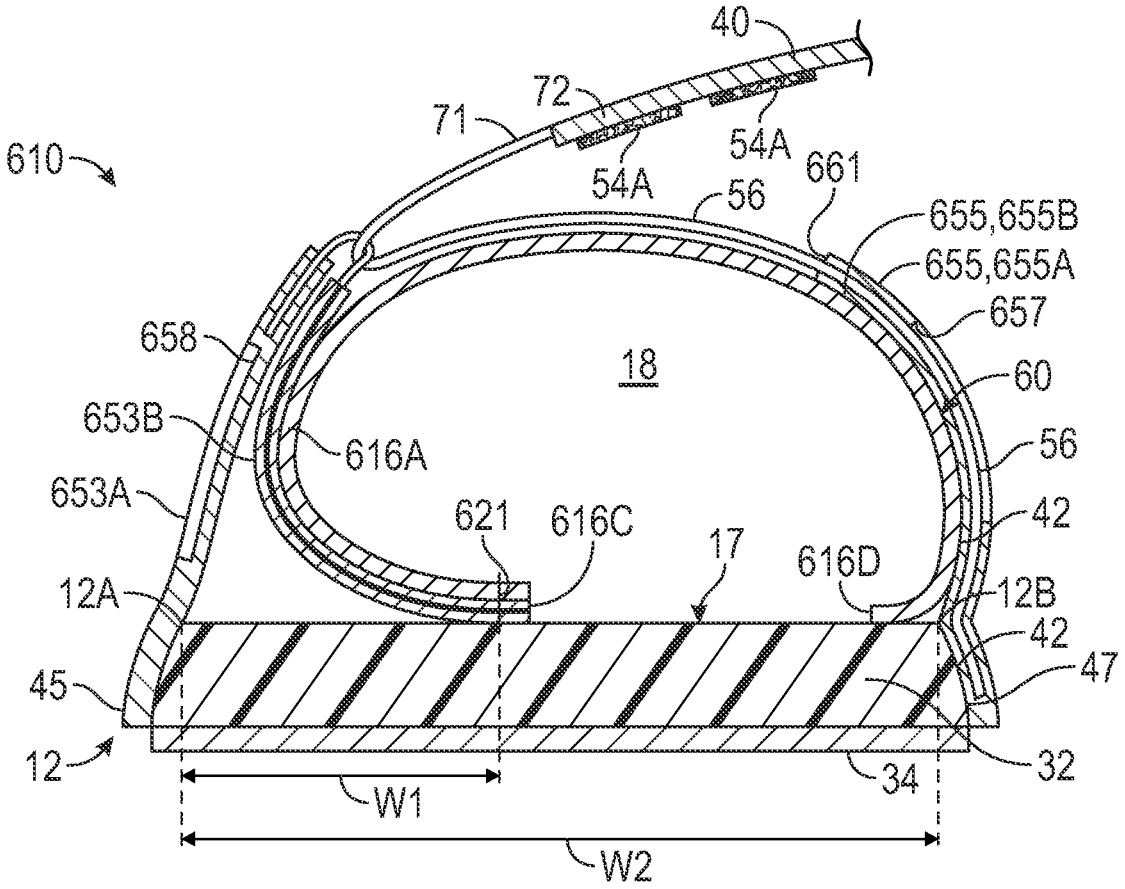
FIG. 26 is a schematic illustration in cross-sectional view of the article of footwear of FIG. 24 taken at lines 26-26 in FIG. 24 and with the strap slightly lifted.

FIGS. 24-26 show another embodiment of an article of footwear 610 that has many of the same features as the article of footwear 10. The article of footwear 610 includes an upper 616 secured to the sole structure 12. The upper 616 has a front section 616A secured at least to a forefoot portion of the sole structure 12, and a rear section 616B operatively secured to the sole structure 12 at least partially rearward of the front section 616A and that articulates from an access position (FIG. 25) to a use position (FIG. 24). The foot-receiving cavity 18 is exposed at the heel region 28 of the article of footwear 610 when the rear section 616B is in the access position, and the rear section 616B partially encloses the heel region 28 when the rear section 616B is in the use position. The strap 40 is configured to wrap behind the rear section 616B from the lateral side 42 of the front section 616A to the medial side 44 of the front section 616A as shown in FIG. 24. As best shown in FIG. 24, the rear section 616B is of a sufficient size to wrap outward of the front section 616A when in the use position. The rear section 616B has fastener portions 654D on medial and lateral sides of an inner surface 662 (also referred to as an inner side) of the rear section 616B that are configured to secure to fastener portions 654E on medial and lateral sides of an outer surface 60 of the front section 616A when the rear section 616B is moved to the use position. Although only partially shown in the views, the fastener portions 654E and 654D are symmetrically disposed on the medial and lateral sides of the footwear 610. The fastener portions 54, 54A on the strap 40 secure to fastener portions 654F disposed on the outer surface of the rear section 616B.

The article of footwear 610 includes a medial-side flap 653 that has an outer medial-side flap 653A and an inner medial-side flap 653B. The outer medial-side flap 653A is secured to the medial side wall 45 of the sole structure 12 and extends upward in a midfoot region 26 of the article of footwear 610. Alternatively, the outer medial-side flap 653A could be secured between the upper 616 and the sole structure 12 at the bite line 50. In either example, the outer medial-side flap 653A is referred to as being secured at the medial side wall 45. The inner medial-side flap 653B is disposed between the upper 616 and the outer medial-side flap 653A. The inner medial-side flap 653B is fixed to the foot-facing surface 17 of the sole structure 12 inward of a medial periphery 12A of the foot-facing surface 17. As used herein, the inner medial-side flap 653B is considered to be fixed to the foot-facing surface 17 if it is fixed directly to the foot-facing surface 17, or if it is fixed indirectly to the foot-facing surface 17, such as by being fixed to a strobel of other component that overlays the foot-facing surface 17, and is not movable relative to the foot-facing surface 17. In the embodiment shown, the inner medial-side flap 653B is stitched to the midsole 32 at the foot-facing surface 17 at stitching 621. The stitching 621 may also extend through the front section 616A. Although the front section 616A is represented as having a medial periphery 616C and a lateral periphery 616D, the front section 616A may be a sock configuration at the location where the cross-section is taken.

The inner medial-side flap 653B is secured to the foot-facing surface 17 between the medial periphery 12A and the lateral periphery 12B rather than at the medial periphery 12A. Stated differently, the inner medial-side flap 653B is secured to the foot-facing surface 17 inward of the medial periphery 12A. The position at which the inner medial-side flap 653B is secured to the foot-facing surface 17 may be customized based upon foot pressure data to correspond with the structure of the wearer's arch (i.e., high arch, low arch, etc.). Alternatively, in a non-customized version, the inner medial-side flap 653B may be positioned to correspond with an average wearer's arch structure. In a non-limiting example, the inner medial-side flap 653B may be secured to the foot-facing surface 17 at a location spaced at least 30 percent of the transverse width W2 of the sole structure 12 toward the lateral periphery 12B from the medial periphery 12A. Accordingly, a distance W1 from the medial periphery 12A to the stitching 621 is at least thirty percent of the overall width W2 from the medial periphery 12A to the lateral periphery 12B.

The inner medial-side flap 653B is fixed to the front section 616A only at the stitching 621. In the drawings, the inner medial-side flap 653B is spaced slightly apart from the front section 616A to indicate that it is not otherwise fixed to the front section 616A and can move relative to the front section 616A. In use, with a foot in the foot-receiving cavity 18, the inner medial-side flap 653B lays against the outer surface 60 of the front section 16A, and lifts and supports the arch of the foot when the strap 40 is fastened as in FIG. 24.

Similar to the article of footwear 510, the looped cables 64 extend upward along the medial side 44 of the footwear 610 and extend from and connect the inner medial-side flap 653B to the outer medial-side flap 653A at free ends of the flaps 653A, 653B.

The article of footwear 610 also includes a lateral-side flap 655 that is secured to the lateral side wall 47 of the sole structure 12 and extends upward along the lateral side 42 of the upper in the midfoot region 26 of the article of footwear 610. In FIG. 26, the lateral-side flap 655 is spaced slightly apart from the front section 616A to indicate that it is not fixed to the front section 616A and can move relative to the front section 616A. In use, with a foot in the foot-receiving cavity 18, the lateral-side flap 655 lays against the outer surface 60 of the front section 16A.

The lateral-side flap 655 has an inner layer 655B and an outer layer 655A, as best shown in FIG. 26, and the tensioning cables 56 extend between the layers 655A, 655B. The outer layer 655A and the inner layer 655B are secured to one another so that the tensioning cables 56 are secured to the lateral-side flap 655. For example, the outer layer 655A and the inner layer 655B may be adhered or stitched to one another. Accordingly, the portions of the tensioning cables 56 that are sandwiched between the outer and the inner layers 655A, 655B do not move relative to the flap 655. Pulling the strap 40 to tension the tensioning cables 56 will thus pull the lateral-side flap 655 against the front section 616A as well as pull the inner medial-side flap 653B against the front section 616A. In FIG. 26, the strap 40 is shown lifted from the front section 616A for clarity. The article of footwear 610 does not include a webbed spacer overlaying and secured to the tensioning cables 56 between the upper 616 and the strap 40, but could include a webbed spacer in an alternative embodiment.

As shown in FIG. 25, the outer layer 655A has an opening 657 that may also be referred to as a window. As best shown in FIGS. 24-25, at least one of the plurality of tensioning cables 56 extends across and is exposed at the opening 657. Each of the plurality of tensioning cables 56 may extend from a free edge 661 of the lateral side flap 655. The outer-medial side flap 653A also has a window 658, but the looped cables 64 are not shown extending across the window 658, and may terminate above the window as shown in FIG. 26.

The plurality of tensioning cables 56 extend through the plurality of looped cables 64 between proximal ends 58 of the plurality of tensioning cables 56 and the strap 40. As best shown in FIG. 26, the proximal end 72 of the strap 40 is connected to distal ends 71 of the plurality of tensioning cables 56. A distal end 52 of the strap 40 is releasably securable to the rear section 616B which is in turn releasably securable to the front section 616A as shown in FIG. 24. More specifically, a first fastener portion 54A is secured to fastener portion 654F on the rear section 616B. The fastener portion 654F may be referred to as a second fastener portion.

The following Clauses provide example configurations of a sole structure for an article of footwear disclosed herein.

Clause 1: An article of footwear comprising: a sole structure; an upper secured to the sole structure; a plurality of tensioning cables having proximal ends fixed to at least one of the upper or the sole structure and extending out of the upper; a strap having a proximal end connected to distal ends of tensioning cables of the plurality of tensioning cables, and the strap having a distal end releasably securable to the upper to tighten the tensioning cables; and a webbed spacer secured to the plurality of tensioning cables, the webbed spacer extending between adjacent ones of the plurality of tensioning cables, the adjacent ones of the plurality of tensioning cables spaced apart from one another by the webbed spacer.

Clause 2: The article of footwear of Clause 1, wherein the webbed spacer is a flexible polymeric material.

Clause 3: The article of footwear of any of Clauses 1-2, wherein spacing between the adjacent ones of the plurality of tensioning cables decreases along the webbed spacer toward the strap.

Clause 4: The article of footwear of any of Clauses 1-3, wherein the webbed spacer is disposed against an outer surface of the upper at a first side of the upper when the distal end of the strap is secured to the upper.

Clause 5: The article of footwear of any of Clauses 1-5, further comprising: a plurality of looped cables fixed to at least one of the upper or the sole structure and extending out of the upper; wherein the plurality of tensioning cables extends through the plurality of looped cables between the proximal ends of the tensioning cables and the webbed spacer.

Clause 6: The article of footwear of Clause 5, wherein: the plurality of tensioning cables extends upward along a first side of the upper from the proximal ends of the plurality of tensioning cables, and the plurality of looped cables extends upward on a second side of the upper; and the webbed spacer rests against the first side of the upper when the distal end of the strap is secured to the upper, the plurality of tensioning cables turning in direction at the plurality of looped cables.

Clause 7: The article of footwear of any of Clauses 1-6, wherein: the upper includes a front section and a rear section defining a foot-receiving cavity; the front section is fixed to a forefoot region of the sole structure; the rear section is operatively secured to the sole structure at least partially rearward of the front section and articulates between an access position and a use position, the foot-receiving cavity being exposed at a heel region of the article of footwear when the rear section is in the access position, and the rear section partially enclosing the heel region when the rear section is in the use position; and the strap is configured to wrap behind the rear section from a first side of the front section to a second side of the front section, and secure to the second side of the front section when the rear section is in the use position.

Clause 8: The article of footwear of Clause 7, further comprising: a first fastener portion secured to the strap at the distal end of the strap; a second fastener portion secured to the second side of the front section of the upper; and wherein the first fastener portion is configured to secure to the second fastener portion.

Clause 9: The article of footwear of Clause 7, wherein: the strap has a plurality of fastener portions spaced along an inner side of the strap; the upper has a plurality of fastener portions secured to rear section, to the first side and to the second side of the front section; and the fastener portions of the strap are configured to secure to the fastener portions of the upper.

Clause 10: The article of footwear of Clause 9, wherein: the first side of the front section is a lateral side of the front section, and the second side of the front section is a medial side of the front section; a rear medial edge of the front section interfaces with the rear section at a medial side interface, and a rear lateral edge of the front section interfaces with the rear section at a lateral side interface; the plurality of fastener portions of the upper includes a front section medial side fastener portion and a rear section medial side fastener portion, both bordering the medial side interface, and further includes a front section lateral side fastener portion and a rear section lateral side fastener portion, both bordering the lateral side interface; and the strap crosses over the medial side interface and the lateral side interface when the rear section is in the use position, and the plurality of fastener portions of the strap is secured to the front section medial side fastener portion, to the rear section medial side fastener portion, to the front section lateral side fastener portion, and to the rear section lateral side fastener portion.

Clause 11: The article of footwear of Clause 10, further comprising: a medial set of magnetic elements including at least one forward medial magnetic element secured to the medial side of the front section, and at least one rear medial magnetic element secured to the medial side of the rear section; a lateral set of magnetic elements including at least one forward lateral magnetic element secured to the lateral side of the front section, and at least one rear lateral magnetic element secured to the lateral side of the rear section; and wherein the rear section is secured to the front section in the use position at least partially by a magnetic coupling of the at least one forward medial magnetic element to the at least one rear medial magnetic element across the medial side interface, and by a magnetic coupling of the at least one forward lateral magnetic element to the at least one rear lateral magnetic element across the lateral side interface.

Clause 12: The article of footwear of Clause 7, wherein: the rear section articulates from the use position to the access position by folding rearward; a forward medial edge of the rear section is nearer to a rear medial edge of the front section when the rear section is in the use position than when the rear section is in the access position; and a forward lateral edge of the rear section is nearer to a rear lateral edge of the front section when the rear section is in the use position than when the rear section is in the access position.

Clause 13: The article of footwear of Clause 7, wherein a rear medial edge and a rear lateral edge of the front section are substantially vertical and entirely in a heel portion of the article of footwear.

Clause 14: An article of footwear comprising: a sole structure; an upper including a front section and a rear section; wherein the front section is fixed to a forefoot region of the sole structure and partially defines a foot-receiving cavity over the sole structure, and the rear section is operatively secured to the sole structure at least partially rearward of the front section and articulates between an access position and a use position, the foot-receiving cavity being exposed at a heel region of the article of footwear when the rear section is in the access position, and the rear section partially enclosing the heel region when the rear section is in the use position; a plurality of tensioning cables extending upward along the front section from proximal ends that are fixed to at least one of the front section of the upper and the sole structure; a strap having a proximal end connected to distal ends of tensioning cables of the plurality of tensioning cables; wherein the strap is configured to wrap around the rear section from a first side of the upper to a second side of the upper; a fastener configured to secure a distal end of the strap to the second side of the upper; and a webbed spacer adjacent to the proximal end of the strap and secured to the plurality of tensioning cables, the webbed spacer extending between adjacent ones of the plurality of tensioning cables, the adjacent ones of the plurality of tensioning cables spaced apart from one another by the webbed spacer.

Clause 15: The article of footwear of Clause 14, further comprising: a plurality of looped cables fixed to at least one of the upper or the sole structure and extending out of the front section of the upper; wherein the plurality of tensioning cables extends through the plurality of looped cables between the proximal ends of the plurality of tensioning cables and the webbed spacer; wherein the plurality of tensioning cables extends upward along the first side of the upper from the proximal ends of the plurality of tensioning cables, and the plurality of looped cables extends outward of the second side of the upper; and wherein the webbed spacer rests against the first side of the upper when the strap is secured to the upper, the plurality of tensioning cables turning in direction at the plurality of looped cables.

Clause 16: The article of footwear of any of Clauses 14-15, wherein: the strap has a plurality of fastener portions spaced along an inner side of the strap; the upper has a plurality of fastener portions secured to the first side and to the second side of the front section; and the fastener portions of the strap are configured to secure to the fastener portions of the upper.

Clause 17: The article of footwear of Clause 16, wherein: the first side of the front section is a lateral side of the front section, and the second side of the front section is a medial side of the front section; a rear medial edge of the front section interfaces with the rear section at a medial side interface, and a rear lateral edge of the front section interfaces with the rear section at a lateral side interface; the plurality of fastener portions of the upper includes a front section medial side fastener portion and a rear section medial side fastener portion, both bordering the medial side interface, and further includes a front section lateral side fastener portion and a rear section lateral side fastener portion, both bordering the lateral side interface; and the strap crosses over the medial side interface and the lateral side interface when the rear section is in the use position, and the plurality of fastener portions of the strap is secured to the front section medial side fastener portion, to the rear section medial side fastener portion, to the front section lateral side fastener portion, and to the rear section lateral side fastener portion.

Clause 18: The article of footwear of Clause 17, further comprising: a medial set of magnetic elements including at least one forward medial magnetic element secured to the medial side of the front section, and at least one rear medial magnetic element secured to the medial side of the rear section; a lateral set of magnetic elements including at least one forward lateral magnetic element secured to the lateral side of the front section, and at least one rear lateral magnetic element secured to the lateral side of the rear section; and wherein the rear section is secured to the front section in the use position at least partially by a magnetic coupling of the at least one forward medial magnetic element to the at least one rear medial magnetic element across the medial side interface, and by a magnetic coupling of the at least one forward lateral magnetic element to the at least one rear lateral magnetic element across the lateral side interface.

Clause 19: The article of footwear of any of Clauses 14-15, wherein: the rear section articulates from the use position to the access position by folding rearward; a forward medial edge of the rear section is nearer to a rear medial edge of the front section when the rear section is in the use position than when the rear section is in the access position; and a forward lateral edge of the rear section is nearer to a rear lateral edge of the front section when the rear section is in the use position than when the rear section is in the access position.

Clause 20: The article of footwear of any of Clauses 14-19, wherein a rear medial edge and a rear lateral edge of the front section are entirely in a heel portion of the article of footwear.

Clause 21: An article of footwear comprising: a sole structure; an upper secured to the sole structure; a medial-side flap secured to a medial side wall of the sole structure and extending upward in a midfoot region of the article of footwear; a plurality of tensioning cables extending upward along a lateral side of the upper; a plurality of looped cables fixed to at least one of the upper or the medial-side flap; a strap having a proximal end connected to distal ends of the plurality of tensioning cables, and the strap having a distal end releasably securable to the upper to tighten the tensioning cables; and wherein the plurality of tensioning cables extends through the plurality of looped cables between proximal ends of the plurality of tensioning cables and the strap.

Clause 22: The article of footwear of Clause 21, further comprising: a webbed spacer secured to the plurality of tensioning cables, the webbed spacer extending between adjacent ones of the plurality of tensioning cables, the adjacent ones of the plurality of tensioning cables spaced apart from one another by the webbed spacer; and wherein the medial-side flap is fixed to a proximal end of the webbed spacer.

Clause 23: The article of footwear of any of Clauses 21-22, wherein the medial-side flap lays against an outer surface of the upper and covers at least some of the plurality of looped cables when the strap is secured to the upper.

Clause 24: The article of footwear of any of Clauses 21-23, wherein both the plurality of tensioning cables and the plurality of looped cables extend through the upper.

Clause 25: The article of footwear of Clause 21, wherein the medial-side flap is an outer medial-side flap, and further comprising: an inner medial-side flap secured to the medial side of the upper and disposed between the upper and the outer medial-side flap; and wherein the plurality of looped cables extends from the inner medial-side flap to the outer medial-side flap.

Clause 26: The article of footwear of Clause 21, further comprising: a lateral-side flap secured to a lateral side of the sole structure and extending upward along the lateral side of the upper in the midfoot region of the article of footwear; and wherein each of the plurality of tensioning cables is secured to the lateral-side flap and extends from a free edge of the lateral side flap.

Clause 27: The article of footwear of Clause 26, wherein: the lateral-side flap has an inner layer and an outer layer; the outer layer has an opening; and at least one of the plurality of tensioning cables extends across and is exposed at the opening.

Clause 28: The article of footwear of Clause 21, wherein the medial-side flap is an outer medial-side flap, and further comprising: an inner medial-side flap disposed between the upper and the outer medial-side flap; wherein the inner medial-side flap is fixed to a foot-facing surface of the sole structure inward of a medial periphery of the foot-facing surface; and wherein the plurality of looped cables extends from the inner medial-side flap to the outer medial-side flap.

Clause 29: The article of footwear of Clause 21, wherein: the medial-side flap is configured with a first portion that extends rearwardly and upwardly from the sole structure, and with a second portion that extends forwardly and upwardly from the sole structure; and the second portion is at least partially rearward of the first portion at the sole structure.

Clause 30: The article of footwear of Clause 21, further comprising: a webbed spacer secured to the plurality of tensioning cables between the looped cables and the strap, the webbed spacer extending between adjacent ones of the plurality of tensioning cables, the adjacent ones of the plurality of tensioning cables spaced apart from one another by the webbed spacer.

Clause 31: The article of footwear of Clause 30, wherein: the webbed spacer rests against the lateral side of the upper when the distal end of the strap is secured to the upper, the plurality of tensioning cables turning in direction at the plurality of looped cables.

Clause 32: The article of footwear of any of Clauses 21-31, further comprising: a first fastener portion secured to the strap at the distal end of the strap; a second fastener portion secured to the upper; and wherein the first fastener portion is configured to secure to the second fastener portion.

Clause 33: The article of footwear of any of Clauses 21-32, wherein: the upper includes a front section and a rear section that form a foot-receiving cavity; the front section is fixed to a forefoot region of the sole structure; the rear section is operatively secured to the sole structure at least partially rearward of the front section and articulates between an access position and a use position, the foot-receiving cavity being exposed at a heel region of the article of footwear when the rear section is in the access position, and the rear section partially enclosing the heel region when the rear section is in the use position; and the strap is configured to wrap behind the rear section from the lateral side of the front section to the medial side of the front section, and secure to the medial side of the upper when the rear section is in the use position.

Clause 34: The article of footwear of Clause 33, wherein: the strap has a plurality of fastener portions spaced along an inner side of the strap; the upper has a plurality of fastener portions secured to rear section, to the lateral side of the front section, and to the medial side of the front section; and the fastener portions of the strap are configured to secure to the fastener portions of the upper.

Clause 35: The article of footwear of Clause 34, wherein: the rear section of the upper has fastener portions on an inner side of the rear section; and the fastener portions on the inner side of the rear section secure to the fastener portions on an outer surface of the front section when the rear section is in the use position.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an upper defining a foot-receiving cavity;

a medial-side flap adjacent to the upper and secured at a medial side of the article of footwear;

a tensioning cable fixed at a lateral side of the article of footwear, extending over the foot-receiving cavity from the lateral side of the article of footwear to an anchoring feature at the medial side of the article of footwear and doubling back from the anchoring feature to the lateral side of the article of footwear, tensioning of the tensioning cable tightening the upper over the foot-receiving cavity;

a sole structure secured to the upper; and a strap connected to the tensioning cable and releasably securable to the upper to tighten the tensioning cable;

wherein:

the upper includes a front section and a rear section that form the foot-receiving cavity;

the front section is secured to a forefoot region of the sole structure;

the rear section is secured to the sole structure at least partially rearward of the front section and articulates between an access position and a use position via the rear section folding relative to the front section at a fold region in the rear section or via a tether coupling the rear section to the front section, the foot-receiving cavity being more exposed when the rear section is in the access position than when the rear section is in the use position; and the strap wraps behind the rear section from the lateral side of the article of footwear and secures to the medial side of the article of footwear when the rear section is in the use position.

2. The article of footwear of claim 1, wherein the tensioning cable extends from the lateral side of the article of footwear, through the anchoring feature, and to the strap.

3. The article of footwear of claim 1, further comprising:

a first fastener portion secured to the strap; and a second fastener portion secured to the upper;

wherein the first fastener portion secures to the second fastener portion.

4. The article of footwear of claim 1, wherein:

the strap has a plurality of fastener portions spaced along an inner side of the strap;

the upper has a plurality of fastener portions secured to the rear section and to the front section; and the fastener portions of the strap secure to the fastener portions of the upper.

5. The article of footwear of claim 1, wherein the anchoring feature is a looped cable fixed at the medial side of the article of footwear.

6. The article of footwear of claim 5, wherein both the tensioning cable and the looped cable extend through the upper.

7. The article of footwear of claim 1, wherein the medial-side flap lays against an outer surface of the upper.

8. The article of footwear of claim 1, wherein the medial-side flap is an outer medial-side flap, and further comprising:

an inner medial-side flap secured at the medial side of the article of footwear and disposed between the upper and the outer medial-side flap.

9. The article of footwear of claim 8, wherein the anchoring feature is a looped cable that extends from the inner medial-side flap to the outer medial-side flap.

10. The article of footwear of claim 1, further comprising a lateral-side flap adjacent to the upper and secured at the lateral side of the article of footwear.

11. The article of footwear of claim 10, wherein the tensioning cable is secured to the lateral-side flap.

12. The article of footwear of claim 11, wherein the tensioning cable extends from a free edge of the lateral side flap.

13. The article of footwear of claim 10, wherein:

the lateral-side flap has an inner layer and an outer layer;

the outer layer has an opening; and the tensioning cable extends across the opening.

14. The article of footwear of claim 1, wherein the medial-side flap is an outer medial-side flap, and further comprising:

an inner medial-side flap disposed between the upper and the outer medial-side flap.

15. The article of footwear of claim 1, wherein the medial-side flap has a first portion that extends rearwardly and upwardly from the sole structure, and a second portion that extends forwardly and upwardly from the sole structure.

16. An article of footwear comprising:

an upper defining a foot-receiving cavity;

a medial-side flap adjacent to the upper and secured at a medial side of the article of footwear;

a tensioning cable fixed at a lateral side of the article of footwear, extending over the foot-receiving cavity from the lateral side of the article of footwear to an anchoring feature at the medial side of the article of footwear and doubling back from the anchoring feature to the lateral side of the article of footwear, tensioning of the tensioning cable tightening the upper over the foot-receiving cavity;

a sole structure secured to the upper; and a strap connected to the tensioning cable and releasably securable to the upper to tighten the tensioning cable;

wherein:

the upper includes a front section and a rear section that form the foot-receiving cavity;

the front section is secured to a forefoot region of the sole structure;

the rear section is secured to the sole structure at least partially rearward of the front section and articulates between an access position and a use position via the rear section folding relative to the front section at a fold region in the rear section or via a tether coupling the rear section to the front section, the foot-receiving cavity being more exposed when the rear section is in the access position than when the rear section is in the use position;

the strap has a plurality of fastener portions spaced along an inner side of the strap;

the upper has a plurality of fastener portions secured to the rear section and to the front section; and the fastener portions of the strap secure to the fastener portions of the upper.

17. An article of footwear comprising:

an upper defining a foot-receiving cavity;

a medial-side flap adjacent to the upper and secured at a medial side of the article of footwear;

a tensioning cable fixed at a lateral side of the article of footwear, extending over the foot-receiving cavity from the lateral side of the article of footwear to an anchoring feature at the medial side of the article of footwear and doubling back from the anchoring feature to the lateral side of the article of footwear, tensioning of the tensioning cable tightening the upper over the foot-receiving cavity; and a sole structure secured to the upper; wherein the medial-side flap has a first portion that extends rearwardly and upwardly from the sole structure, and a second portion that extends forwardly and upwardly from the sole structure.

18. An article of footwear comprising:

an upper defining a foot-receiving cavity;

a medial-side flap adjacent to the upper and secured at a medial side of the article of footwear; and a tensioning cable fixed at a lateral side of the article of footwear, extending over the foot-receiving cavity from the lateral side of the article of footwear to an anchoring feature at the medial side of the article of footwear and doubling back from the anchoring feature to the lateral side of the article of footwear, tensioning of the tensioning cable tightening the upper over the foot-receiving cavity;

wherein the medial-side flap is an outer medial-side flap, and further comprising an inner medial-side flap secured at the medial side of the article of footwear and disposed between the upper and the outer medial-side flap; and wherein the anchoring feature is a looped cable that extends from the inner medial-side flap to the outer medial-side flap.

19. An article of footwear comprising:

an upper defining a foot-receiving cavity;

a medial-side flap adjacent to the upper and secured at a medial side of the article of footwear;

a lateral-side flap adjacent to the upper and secured at the lateral side of the article of footwear; and a tensioning cable fixed at a lateral side of the article of footwear, extending over the foot-receiving cavity from the lateral side of the article of footwear to an anchoring feature at the medial side of the article of footwear and doubling back from the anchoring feature to the lateral side of the article of footwear, tensioning of the tensioning cable tightening the upper over the foot-receiving cavity;

wherein:

the lateral-side flap has an inner layer and an outer layer;

the outer layer has an opening; and the tensioning cable extends across the opening.

* * * * *